US008106847B2

(12) United States Patent
Yoshida et al.

(10) Patent No.: US 8,106,847 B2
(45) Date of Patent: Jan. 31, 2012

(54) COMMUNICATION CIRCUIT, COMMUNICATION APPARATUS, IMPEDANCE MATCHING CIRCUIT AND IMPEDANCE MATCHING CIRCUIT DESIGNING METHOD

(75) Inventors: Keiji Yoshida, Fukuoka (JP); Haruichi Kanaya, Fukuoka (JP)

(73) Assignees: Kyushu University, National University Corporation, Fukuoka (JP); Fukuoka Industry, Science and Technology Foundation, Fukuoka (JP)

( * ) Notice: Subject to any disclaimer, the term of this patent is extended or adjusted under 35 U.S.C. 154(b) by 500 days.

(21) Appl. No.: 11/886,640

(22) PCT Filed: Mar. 3, 2006

(86) PCT No.: PCT/JP2006/304154
§ 371 (c)(1),
(2), (4) Date: May 21, 2009

(87) PCT Pub. No.: WO2006/126320
PCT Pub. Date: Nov. 30, 2006

(65) Prior Publication Data

US 2009/0295671 A1 Dec. 3, 2009

(30) Foreign Application Priority Data

Mar. 18, 2005 (JP) ..... 2005-080671

(51) Int. Cl.
*H01Q 1/50* (2006.01)

(52) U.S. Cl. ..... 343/860; 343/862

(58) Field of Classification Search ..... 343/700 MS, 343/850, 859, 860, 862
See application file for complete search history.

(56) References Cited

U.S. PATENT DOCUMENTS

| | | | | |
|---|---|---|---|---|
| 4,724,381 | A | 2/1988 | Crimmins | |
| 5,068,670 | A * | 11/1991 | Maoz | 343/767 |
| 5,557,290 | A | 9/1996 | Watanabe | |
| 5,734,355 | A | 3/1998 | Watanabe | |
| 6,429,828 | B1 | 8/2002 | Tinaphong et al. | |
| 6,806,839 | B2 * | 10/2004 | Lo | 343/725 |
| 2005/0156802 | A1 * | 7/2005 | Livingston et al. | 343/770 |

FOREIGN PATENT DOCUMENTS

| | | |
|---|---|---|
| JP | 06-090108 | 3/1994 |
| JP | 06-204733 | 7/1994 |
| JP | 2509457 | 4/1996 |
| JP | 2611763 | 2/1997 |
| JP | 2807169 | 7/1998 |
| JP | 2001-526481 | 12/2001 |
| JP | 2003-283211 | 10/2003 |
| JP | 2004-274513 | 9/2004 |
| WO | 99/30385 | 6/1999 |

* cited by examiner

*Primary Examiner* — Hoanganh Le
(74) *Attorney, Agent, or Firm* — Rankin, Hill & Clark LLP

(57) ABSTRACT

A communication circuit is provided with an antenna section, such as a nonresonant antenna, and a matching section which connects with the antenna section and adjusts impedance, for example. The matching section has a transmission line, and the electric length and characteristic impedance of the transmission line are determined based on the frequency or the frequency band in which the antenna section and the transmission line resonate. For example, since it is not necessary to unite resonance frequency with center frequency if it is a nonresonant antenna, it becomes possible to attain the miniaturization of an antenna. Wide band-ization is realizable by changing the characteristic impedance of the transmission line.

4 Claims, 10 Drawing Sheets

COMMUNICATION CIRCUIT, COMMUNICATION APPARATUS, IMPEDANCE MATCHING CIRCUIT AND IMPEDANCE MATCHING CIRCUIT DESIGNING METHOD

This application is a National Phase Application of International Application No. PCT/JP2006/304154, filed Mar. 3, 2006, which claims the priority of Japan Patent Application No. 2005-080671, filed Mar. 18, 2005. The present application claims priority from both applications and each of these applications is herein incorporated in their entirety by reference.

FIELD OF THE INVENTION

This invention relates to a communication circuit and a design method of an impedance-matching circuit, especially it relates to a communication circuit having an impedance-matching circuit with a transmission line, and so on.

BACKGROUND OF THE INVENTION

In an information-oriented society in recent years, the system using radio, such as mobile communications and satellite communications, has spread quickly. Along with that, more miniaturization has been required of communications systems in addition to high performance and high efficiency. The size of communications systems is highly dependent on the size of an antenna. Therefore, in order to miniaturize communications systems, it becomes important to miniaturize an antenna, without lowering its performance.

A sufficiently small antenna, as compared with the wavelength of the radio signal used in communications systems, is called a miniaturized antenna. Various design methods have been proposed as a miniaturized antenna (for example, refer to Patent Literature 1, Patent Literature 2, and Non Patent Literature 1).

[Patent Literature 1]: JP 2004-274513 A

[Patent Literature 2]: JP 2003-283211 A

[Non Patent Literature 1]: Yoko Koga, et al., "Design and Evaluation of Miniaturized HTS Slot Array Antenna with Bandpass Filter", the technical report of the proceeding of the Institute of Electronics, Information and Communication Engineers (SCE2002-5, MW2002-5), 2002, p.23-28

DESCRIPTION OF THE INVENTION

Problem(s) to be Solved by the Invention

The conventional antenna is a resonance type. The resonant antenna requires to adjust resonance frequency to center frequency. Therefore, the size is determined by the resonance frequency and so it is difficult to design the size freely. Such difficulty also exists for loads in general other than an antenna.

Therefore, the purpose of this invention is to provide the communication circuit and the design method of impedance-matching circuit which suit the miniaturization requirement of an antenna etc.

Means for Solving the Problem

The first aspect of the present invention is the communication circuit including a nonresonant antenna and an impedance-matching circuit connected to the nonresonant antenna, wherein the impedance-matching circuit has a transmission line whose electric length and characteristic impedance are determined by resonance frequency or resonance frequency band in which the nonresonant antenna and the transmission line resonate.

It may be the communication circuit according to the first aspect, wherein the nonresonant antenna is in-series nonresonant or parallel nonresonant. In this case, the electric length and characteristic impedance of the transmission line may be determined based on the internal impedance of the antenna, when the antenna is in-series nonresonant. Or the electric length and characteristic impedance of the transmission line may be determined based on the internal admittance of the antenna, when said antenna is parallel nonresonant.

Further, it may be the communication circuit according to the first aspect, wherein the impedance-matching circuit has an inverter. In this case, matching can be realized by adjusting the shape of the inverter and changing a parameter, even when the rate of impedance conversion is very large.

Further, it may be the communication circuit according to the first aspect, wherein the transmission line is a distributed element line formed in dielectric substrates such as, for example, a coplanar waveguide.

Further, it may be the communication circuit according to the first aspect, wherein the transmission line may be meander shape. In this case, the transmission line is not formed straight line but bent line, which realizes the miniaturization of the whole length. Further, if it is possible to form a transmission line inside an antenna, for example, in such a case that an antenna is parallel nonresonant, the size of the whole circuit can substantially be as small as the size of an antenna.

Further, the communication circuit according to the first aspect may be made using high-temperature superconductor, which shows a very low conductive loss. In this case, the communication circuit can be less affected by conductive loss, which is one of the main cause of decreasing efficiency of miniature communication circuit.

Further, the communication circuit according to the first aspect may be a transmitting circuit, a receiving circuit, or a transceiver circuit.

The second aspect of the present invention is a communication circuit, comprising a nonresonant antenna and an impedance-matching circuit connected to the nonresonant antenna, wherein the impedance-matching circuit has a transmission line, electric length $\theta_0$ and characteristic impedance $Z_1$ of the transmission line are calculated by equation (eq1) using external Q $Q_{e1}$ and reactance $X_a$ and radiation resistance $R_a$ of the nonresonant antenna.

The third aspect of the present invention is a communication circuit, comprising a nonresonant antenna and an impedance-matching circuit connected to the nonresonant antenna, wherein the impedance-matching circuit has a transmission line, electric length $\theta_0$ and characteristic admittance $Y_1$ of the transmission line are calculated by equation (eq2) using external Q $Q_{e1}$ and susceptance $B_a$ and conductance $G_a$ of the nonresonant antenna.

The fourth aspect of the present invention is a communication device including the communication circuit of the first, second or third aspect.

The fifth aspect of the present invention is a design method of an impedance-matching circuit to be connected to a nonresonant antenna, wherein the impedance-matching circuit has a transmission line one of ends of which is connected to the nonresonant antenna, the design method comprising a step of determining electric length $\theta_0$ and characteristic impedance $Z_1$ of the transmission line by equation (eq3) using external Q $Q_{e1}$ and reactance $X_a$ and radiation resistance $R_a$ of the nonresonant antenna.

The sixth aspect of the present invention is a design method of an impedance-matching circuit to be connected to a nonresonant antenna, wherein the impedance-matching circuit has a transmission line one of ends of which is connected to the nonresonant antenna, the design method comprising a step of determining electric length $\theta_0$ and characteristic impedance $Z_1$ of the transmission line by equation (eq4) using external Q $Q_{e1}$ and susceptance $B_a$ and conductance $G_a$ of the nonresonant antenna.

The seventh aspect of the present invention is a method of producing an impedance-matching circuit by using the design method of the fifth or sixth aspect.

Equation 1

$$\theta_0 = \frac{1}{2}\mathrm{Sinc}^{-1}\left(\frac{X_a}{2Q_{e1}R_a - X_a}\right),\ Z_1 = X_a\tan\theta_0 \quad \text{(eq1)}$$

$$\theta_0 = \frac{1}{2}\mathrm{Sinc}^{-1}\left(\frac{B_a}{2Q_{e1}G_a - B_a}\right),\ Y_1 = Y_a\tan\theta \quad \text{(eq2)}$$

Equation 2

$$\theta_0 = \frac{1}{2}\mathrm{Sinc}^{-1}\left(\frac{X_a}{2Q_{e1}R_a - X_a}\right),\ Z_1 = X_a\tan\theta_0 \quad \text{(eq3)}$$

$$\theta_0 = \frac{1}{2}\mathrm{Sinc}^{-1}\left(\frac{B_a}{2Q_{e1}G_a - B_a}\right),\ Y_1 = Y_a\tan\theta \quad \text{(eq4)}$$

Effect of the Invention

According to the invention in this application, it becomes possible to design a resonator with an impedance-matching circuit and a nonresonant antenna etc. combined. For example, as for a nonresonant antenna, it is not necessary to adjust resonance frequency to center frequency. Therefore, it becomes possible to miniaturize an antenna which allows further miniaturization of the whole communications systems. Further, the change of characteristic impedance of a transmission line can broaden bandwidth.

Performance prediction was performed by the electromagnetic field simulator about the resonator with a slotted dipole antenna and a matching circuit combined on a high-temperature superconductivity thin film substrate. The size of the obtained antenna is 3100 [μm]×1900 [μm], including the matching circuit. This size can be found very small when compared with wavelength λ (about 26000 [μm]). The size of its antenna section only is 3070 [μm]×600 [μm]. The typical half wavelength rectangle patch antenna used for wireless LAN is about 13000 [μm]×13000 [μm] for the same center frequency and dielectric constant of the substrate. Therefore, as compared with the typical antenna, the area of the obtained antenna is about 1/91, which is remarkable miniaturization.

BRIEF DESCRIPTION OF THE DRAWINGS

FIG. 2(*a*) shows an example of a miniaturized slotted dipole antenna. FIG. 2(*b*) shows the frequency characteristic of the impedance. FIG. 2(*c*) shows the equivalent circuit of this antenna.

FIG. 5(*a*) shows a circuit with load impedance $Z_a$ connected to the lossless transmission line of electric length θ and characteristic impedance $Z_1$. FIG. 5(*c*) shows a circuit in which the circuit of FIG. 5(*b*) is connected with the exterior via J inverter.

FIG. 8(*a*) shows the structure of a section. FIG. 8(*b*) shows its top view.

FIG. 12(*a*) shows substrate thickness. FIG. 12(*b*) shows the miniaturized dipole antenna, based on the design method of the present invention. FIG. 12(*c*) shows a one-wave length slot antenna. FIG. 12(*d*) shows a patch antenna.

FIG. 16(*a*) shows a circuit where K inverter is connected to the antenna equivalent circuit with a matching circuit. FIG. 16(*b*) shows a circuit in which a filter is used.

DESCRIPTION OF NOTATIONS

1 Communication Circuit
3 Antenna Section
5 Matching Section

BEST MODE OF CARRYING OUT THE INVENTION

Figure 1:
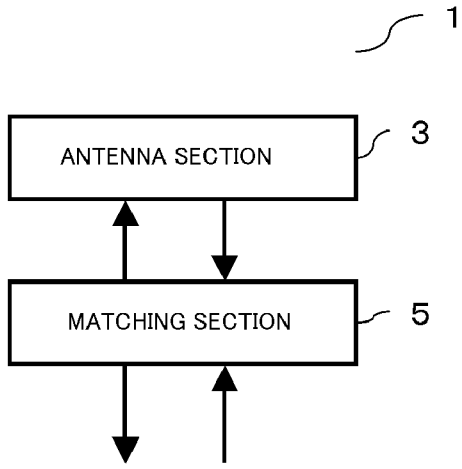
FIG. 1 is a schematic block diagram of communication circuit 1 concerning an embodiment of the present invention.

FIG. 1 is a schematic block diagram of communication circuit 1 concerning an embodiment of the present invention. Communication circuit 1 includes antenna section 3 and matching section 5 connected to the antenna section 3. The matching section 5 adjusts impedance.

Figure 2:
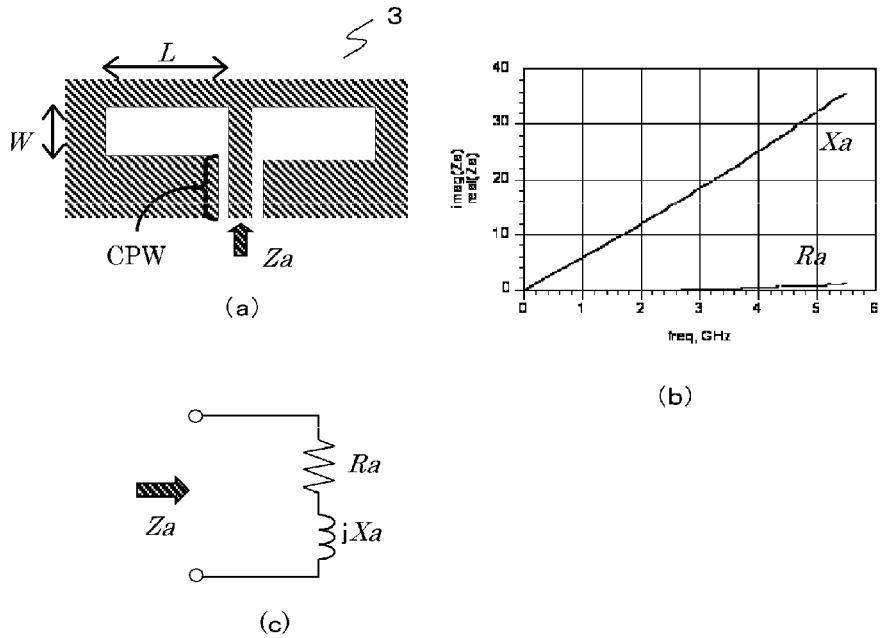
FIG. 2 shows an antenna which is an example of antenna section 3 of FIG. 1.

FIG. 2(*a*) is a figure showing the miniaturized slotted dipole antenna which is an example of antenna section 3 of FIG. 1. The antenna is connected to matching section 5 by the coplanar waveguide (CPW) in this example. In FIG. 2(*a*), $L \ll \lambda$ holds for antenna length L [μm] and guide wavelength λ [μm]. FIG. 2(*b*) is an example of an electromagnetic field simulation analysis of the antenna of FIG. 2(*a*) and the frequency characteristic of the impedance $Z_a$ is shown. Inclination of radiation resistance $R_a$ and reactance $X_a$ is constant around center frequency (for example, 5.0 GHz). Therefore, the equivalent circuit of this antenna can be expressed by the series circuit of radiation resistance $R_a$ and reactance $X_a$ as shown in FIG. 2(*c*). The point of this antenna is short-shaped and this antenna is called in-series nonresonant.

Figure 3:
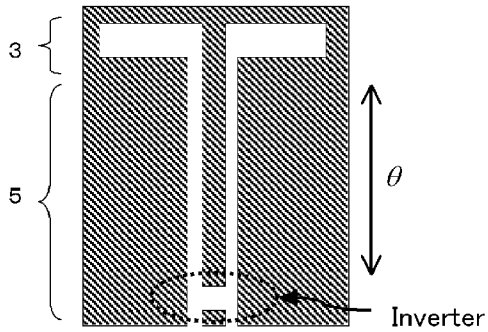
FIG. 3 shows a matching circuit which is an example of matching section 5 of FIG. 1.

FIG. 3 is a figure showing the matching circuit which is an example of matching section 5 of FIG. 1. In FIG. 3, the matching circuit has a transmission line and an inverter. Transmission lines are two parallel signal lines and the electric length is θ. One of the ends of these signal lines is connected with antenna section 3, and the other end is connected outside via an inverter.

In this embodiment, matching section 5 of FIG. 1 is designed using characteristic impedance $Z_1$ and electric length $\theta_0$ of a transmission line which are obtained based on the design formula of equation (1). In the equation (1), $Q_{e1}$ is external Q (coupling amount with an external circuit) of a resonator (refer to equation (53)). Function Sinc(θ) is defined by Sinc(θ)=sin θ/θ (refer to FIG. 7). The design formula of this equation (1) is derived based on the conditions that an antenna equivalent circuit having a matching circuit (refer to FIG. 5(*c*)) and the circuit based on filter theory (refer to FIG. 6) are equivalences. The details will be described later. cl Equation 3

$$Z_1 = X_a \tan\theta_0,\ \theta_0 = \frac{1}{2}\mathrm{Sinc}^{-1}\left(\frac{X_a}{2Q_{e1}R_a - X_a}\right) \tag{1}$$

The design formula of equation (1) is explained focusing on the derivation using FIGS. 4-7.

First, a band-pass filter is explained. A filter is a device which passes the signal of a certain required frequency band, and intercepts the signal of an unnecessary frequency band. An example of a commonly used band-pass filter is a Chebyshev filter. Below, a design formula for a Chebyshev filter is described. The design formulas for filters other than a Chebyshev filter, such as butterworth filter for example, can be similarly derived.

For the fractional bandwidth of the desired band-pass filter w and center frequency $\omega_0$, the fractional bandwidth w and center frequency $\omega_0$ have a relationship expressed in equation (2). Here, $\omega_1$ and $\omega_2$ are cutoff angular frequency.

Equation 4

$$w = \frac{\omega_2 - \omega_1}{\omega_0},\ \omega_0 = \sqrt{\omega_1\omega_2} \tag{2}$$

The n step band-pass filter has a LC series resonator and LC parallel resonator (For example, refer to G. L. Matthaei, "Microwave Filters, Impendence-matching Networks, and Coupling Structures", Artech House, 1980, p.429). $L_k$ and $C_k$ of LC series resonator are expressed by equation (3), and $L_j$ and $C_j$ of LC parallel resonator are expressed by equation (4). Here, $g_i$ is a normalization device value, which is expressed by equation (5) for the reflection coefficient $RL_r$ at the point where the ripple of a pass band reaches the maximum. β, γ, $a_k$, and $b_k$ are expressed by equation (6) and equation (7).

Equation 5

$$L_k = \frac{g_k}{w\omega_0},\ C_k = \frac{w}{\omega_0 g_k} \tag{3}$$

$$C_j = \frac{g_j}{w\omega_0},\ L_j = \frac{w}{\omega_0 g_j} \tag{4}$$

$$g_0 = 1,\ g_1 = \frac{2a_1}{\gamma},\ g_k = \frac{4a_{k-1}a_k}{b_{k-1}g_{k-1}}\ k = 2, \ldots, n, \tag{5}$$

$$g_{n+1} = \begin{cases} 1 & n\text{: odd} \\ \coth^2\left(\frac{\beta}{4}\right) & n\text{: even} \end{cases}$$

$$\beta = \ln\left(\coth\frac{-10\ln\left|1 - 10^{\frac{RL_r}{10}}\right|}{17.37}\right),\ \gamma = \sinh\left(\frac{\beta}{2n}\right) \tag{6}$$

$$a_k = \sin\left[\frac{(2k-1)\pi}{2n}\right]\ k = 1, 2, \ldots, n, \tag{7}$$

$$b_k = \gamma^2 + \sin^2\left(\frac{k\pi}{n}\right) k = 1, 2, \ldots, n$$

In a two-terminal pair network, a reflection coefficient and a transmission coefficient are used as parameters for evaluating propagation of electric power and a signal wave. These are obtained by equation (8) from an S matrix. Here, they are $S_{11}$=(reflection electric power)/(input power) and $S_{21}$=(transmission electric power)/(input power).

Equation 6

$$RL = |S_{11}|\ [\mathrm{dB}] = 20\log_{10}|S_{11}|,\ IL = |S_{21}|\ [\mathrm{dB}] = 20\log_{10}|S_{21}| \tag{8}$$

In general, the performance of a receiving antenna is evaluated using a transmission coefficient. In the case where a conductor loss can be ignored, $|S_{11}|^2+|S_{21}|^2=1$. Then, the design of the transmission coefficient can be performed simultaneously with the design of reflection coefficient which is the characteristics of a matching circuit. When it comes to the gain which is the characteristics of an antenna, transmitting gain and receiving gain are equivalent. And in the electromagnetic field simulator described later, analysis of a reflection coefficient is conducted based on the characteristics of the gain. Therefore, in the following, the performance is evaluated using a reflection coefficient.

Then, the slope parameter showing the characteristics of resonators, such as a series resonator and a parallel resonator, is explained. First, as for a series resonator, reactance slope parameter $x_k$ is defined by equation (9) for the reactance of a series resonator, $X_k$. Reactance $X_k$ and resonance frequency $\omega_0$ of a series resonator is shown in equation (10). Therefore, reactance slope parameter $x_k$ is expressed by equation (11). Reactance $X_k$ of a series resonator is expressed by equation (12).

Equation 7

$$x_k = \frac{\omega_0}{2}\frac{dX_k}{d\omega}\bigg|_{\omega=\omega_0} \tag{9}$$

$$X_k = \omega l_k - \frac{1}{\omega C_k},\quad \omega_0 = \frac{1}{\sqrt{L_k C_k}} \tag{10}$$

$$x_k = \omega_0 L_k = \frac{1}{\omega_0 C_k} = \frac{w}{g_k} \tag{11}$$

$$X_k = x_k\left(\frac{\omega}{\omega_0} - \frac{\omega_0}{\omega}\right) \tag{12}$$

As for a parallel resonator, susceptance slope parameter $b_j$ is similarly defined by equation (13) for susceptance $B_j$. Susceptance $B_j$ and resonance frequency $\omega_0$ of a parallel resonator are expressed by equation (14). Therefore, susceptance slope parameter $b_j$ is expressed by equation (15). Susceptance $B_j$ of a parallel resonator is expressed by equation (16).

Equation 8

$$b_j = \frac{\omega_0}{2}\frac{dB_j}{d\omega}\bigg|_{\omega=\omega_0} \tag{13}$$

$$B_j = \omega C_j - \frac{1}{\omega L_j},\ \omega_0 = \frac{1}{\sqrt{L_j C_j}} \tag{14}$$

$$b_j = \omega_0 C_j = \frac{1}{\omega_0 L_j} = \frac{g_j}{w} \tag{15}$$

$$B_j = b_j\left(\frac{\omega}{\omega_0} - \frac{\omega_0}{\omega}\right) \tag{16}$$

Then, the composition of the filter having an inverter is explained. Inverters include J inverter and K inverter. Each of these inverters is an element whose image phase quantities differ by $\pm\pi/2$ or an odd multiple of $\pm\pi/2$ between at its input terminal and at its output terminal. Therefore, seen from the input terminal of an inverter, load impedance seems as if it is reversed. The cascade matrix (matrix which determines the output voltage and the output current when the input voltage and the input current of a circuit) of an inverter is expressed using equation (17) by definition. Here, K and J in the matrix are called K parameter and J parameter, respectively, and the relation K=1/J holds.

Equation 9

$$[K] = \begin{bmatrix} 0 & \pm jK \\ \pm jJ & 0 \end{bmatrix} \tag{17}$$

Then, a circuit provided with a parallel resonator and J inverter is examined. Suppose a circuit where a parallel resonator whose susceptance B' is connected to the exterior via J inverter. As the cascade matrix is expressed by equation (18), this circuit becomes equivalent to the series resonator of reactance X, if B' is set to $B'=J^2X$. Therefore, the series resonator is equivalent to a circuit having a parallel resonator and J inverter. Therefore, n step band-pass filter can be designed with only parallel resonators and J inverters. Susceptance $B_i$ and J parameter of the parallel resonators are expressed by equation (19) and equation (20), respectively.

Equation 10

$$[K] = \begin{bmatrix} 0 & -j\frac{1}{J} \\ -jJ & 0 \end{bmatrix}\begin{bmatrix} 1 & 0 \\ jB' & 1 \end{bmatrix}\begin{bmatrix} 0 & -j\frac{1}{J} \\ -jJ & 0 \end{bmatrix} = -\begin{bmatrix} 1 & j\frac{B'}{J^2} \\ 0 & 2 \end{bmatrix} \tag{18}$$

$$J_{0,1} = \sqrt{w}\sqrt{\frac{b_1}{Z_0 g_0 g_1}},\ J_{i,i+1} = w\sqrt{\frac{b_j b_{j+1}}{g_j g_{j+1}}}\quad i = 1, 2\ldots n-1,\quad J_{n,n+1} = \sqrt{w}\sqrt{\frac{b_n}{Z_0 g_n}} \tag{19}$$

$$B_i = b_i\left(\frac{\omega}{\omega_0} - \frac{\omega_0}{\omega}\right)\ i = 1, 2\ldots n \tag{20}$$

Then, a distributed element line is explained with reference to FIG. 4. For high frequencies, it becomes difficult to realize a circuit using concentrated passive devices such as a capacitance and a reactance because the size of a circuit cannot be ignored compared with the wavelength. And so, current and voltage are considered to be the functions of time and position, and transmission circuitry is approximated by the distribution of miniaturized circuits in the propagation direction of current and voltage. This approximated circuit is called a distributed element line.

Figure 4:
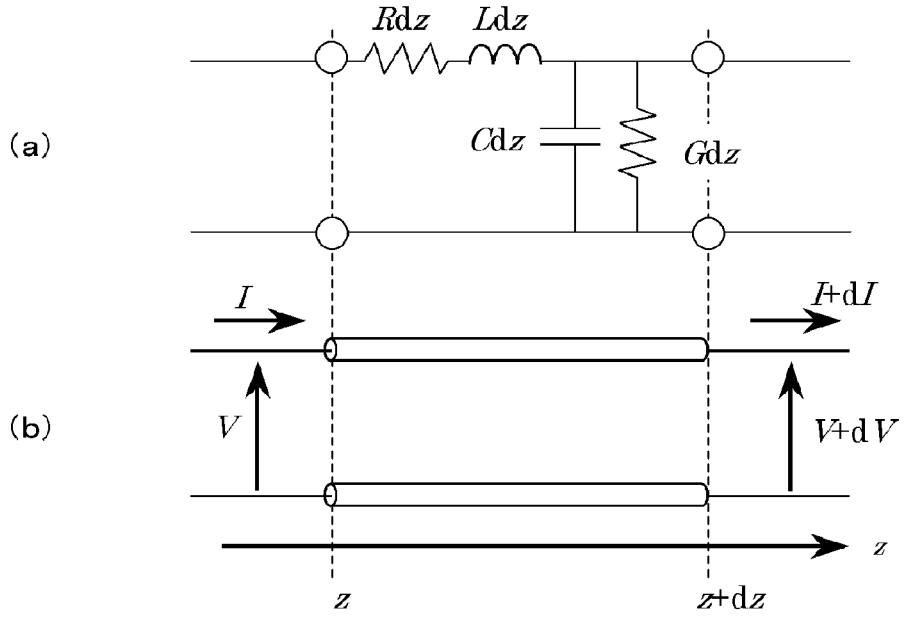
FIG. 4 shows the concept of distributed element line.

The circuit shown in FIG. 4(*a*) is equivalent to that shown in FIG. 4(*b*) for miniaturized sections dz on a line. The differential equation about the current and voltage of this circuit is expressed by equation (21) and equation (22) is obtained as the solution to equation (21). Here, $K_1$ and $K_2$ are arbitrary constants, $\gamma$ and $Z_0$ are called a propagation constant and characteristic impedance, respectively, and expressed by equation (23).

Real part $\alpha$ of complex notation of the propagation constant $\gamma$ is called an attenuation coefficient, and imaginary part β is called a phase constant. Since R<<ωL and G<<ωC hold in a general transmission line, α and β can be expressed by equation (24).

Equation 11

$$-\frac{dV}{dz} = (R + j\omega L)I,\ -\frac{dI}{dz} = (G + j\omega C)V \tag{21}$$

$$V(z) = K_1 e^{-\gamma z} + K_2 e^{\gamma z},\ I(z) = \frac{1}{Z_0}(K_1 e^{-\gamma z} - K_2 e^{\gamma 2}) \tag{22}$$

$$\gamma = \sqrt{(R + j\omega L)(G + j\omega C)} = \alpha + j\beta,\ Z_0 = \sqrt{\frac{R + j\omega L}{G + j\omega C}} \tag{23}$$

$$\alpha \approx \frac{1}{2}\left(\frac{R}{Z_0} + GZ_0\right),\ \beta \approx \omega\sqrt{LC} \tag{24}$$

Then, the cascade matrix showing the transmission line of length 1 is considered. If $V(0)=V_1$ and $I(0)=I_1$, the boundary condition of equation (25) is obtained from equation (22). By using this boundary condition and the relation expressed by equation (26) in equation (22), equation (27) is derived. Therefore, voltage $V_2$ and current $I_2$ at z=1 are expressed by equation (28). If equation (28) is expressed using an inverse matrix, the cascade matrix of the transmission line of characteristic impedance $Z_0$ and length 1 is expressed by equation (29). In the case of α<<1, equation (29) is expressed by equation (30) for electric length corresponding to length 1, θ, using γ1=j β1=j θ.

Equation 12

$$V_1 = K_1 + K_2,\ I_1 = \frac{1}{Z_0}(K_1 - K_2) \tag{25}$$

$$e^{\pm\gamma z} = \cosh\gamma z \pm \sinh\gamma z \tag{26}$$

$$V(z) = V_1\cosh\gamma z - Z_0 I_1 \sinh\gamma z,\ I(z) = -\frac{V_1}{Z_0}\sinh\gamma z + I_1\cosh\gamma z \tag{27}$$

$$\begin{pmatrix} V_2 \\ -I_2 \end{pmatrix} = \begin{pmatrix} \cosh\gamma l & -Z_0\sinh\gamma l \\ -\frac{1}{Z_0}\sinh\gamma l & \cosh\gamma l \end{pmatrix}\begin{pmatrix} V_1 \\ I_1 \end{pmatrix} \tag{28}$$

$$\begin{pmatrix} V_1 \\ I_1 \end{pmatrix} = \begin{pmatrix} \cosh\gamma l & Z_0\sinh\gamma l \\ \frac{1}{Z_0}\sinh\gamma l & \cosh\gamma l \end{pmatrix}\begin{pmatrix} V_2 \\ -I_2 \end{pmatrix} \tag{29}$$

$$\begin{pmatrix} V_1 \\ I_1 \end{pmatrix} = \begin{pmatrix} \cos\theta & Z_0\sin\theta \\ \frac{1}{Z_0}\sin\theta & \cos\theta \end{pmatrix}\begin{pmatrix} V_2 \\ -I_2 \end{pmatrix} \tag{30}$$

The above filter theory is applied to derive the design theory of matching section 5 of FIG. 1. When an antenna is in-series nonresonant, an antenna is expressed by the series circuit of radiation resistance $R_a$ and reactance $X_a$ as shown in FIG. 2(*c*). Its impedance $Z_a$ is expressed by $Z_a=R_a+j X_a=R_a+j\omega L$.

Figure 5:
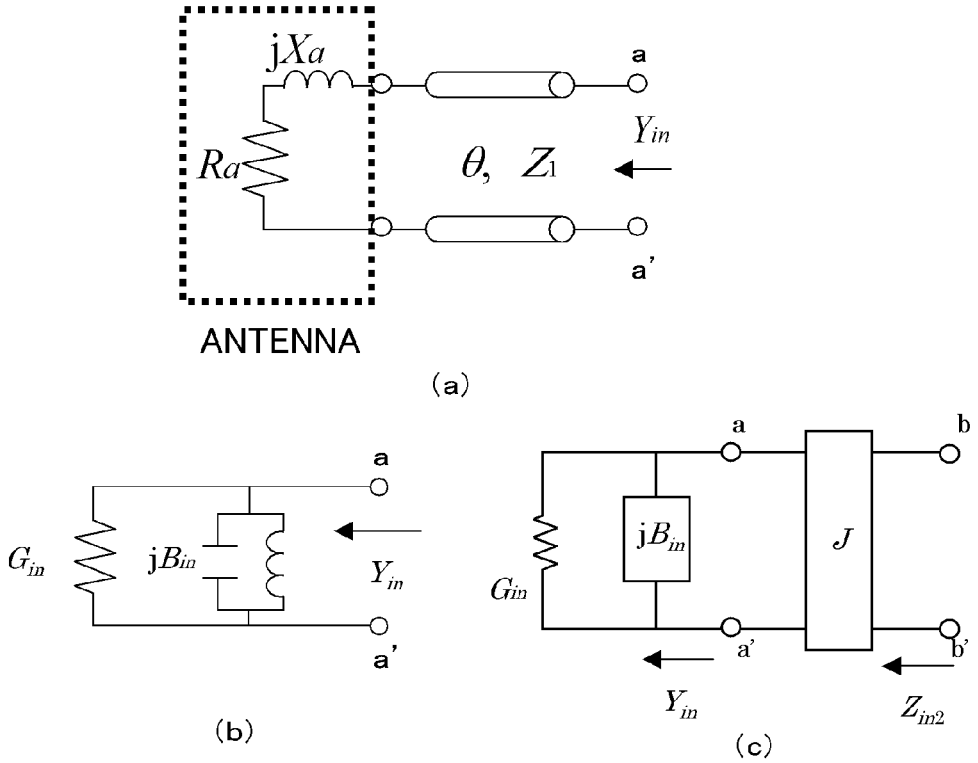
FIG. 5 shows an antenna equivalent circuit having a matching circuit with the antenna of FIG. 2 and matching section 5 of FIG. 3.

FIG. 5(*a*) is a figure showing the circuit in which load impedance $Z_a$ is connected to the lossless transmission line of electric length θ and characteristic impedance $Z_1$. From equation (30), input impedance $Z_{in}$ seen from terminal a-a' is expressed by equation (31).

FIG. 5(*b*) is a figure showing the parallel resonant circuit of center frequency $\omega_0$ which the circuit of FIG. 5(*a*) can be regarded as equivalent to, when a transmission line is made into suitable length (referred to as $\theta_0$ below). Input admittance $Y_{in}$ ($Y_{in}=1/Z_{in}$) of this parallel resonant circuit is expressed by equation (32) (refer to the equation (16)). Here, susceptance slope parameter b is expressed by equation (33) (refer to the equation (13)).

FIG. 5(*c*) is a figure showing a circuit where the circuit of FIG. 5(*b*) is connected with the exterior via the J inverter. Input impedance $Z_{in2}$ of the circuit of FIG. 5(*c*) is expressed by equation (34).

Equation 13

$$Z_{in} = Z_1\frac{Z_a + jZ_1\tan\theta}{Z_1 + jZ_a\tan\theta} \tag{31}$$

$$Y_{in} = G_{in} + jB_{in} = G_{in} + jb\left(\frac{\omega}{\omega_0} - \frac{\omega_0}{\omega}\right) \tag{32}$$

$$b = \frac{\omega_0}{2}\frac{dB_{in}}{d\omega}\bigg|_{\omega\,\omega_0} \tag{33}$$

$$Z_{in2} = \frac{Y_{in}}{J^2} = \frac{G_{in}}{J^2} + j\frac{b}{J^2}\left(\frac{\omega}{\omega_0} - \frac{\omega_0}{\omega}\right) \tag{34}$$

Figure 6:
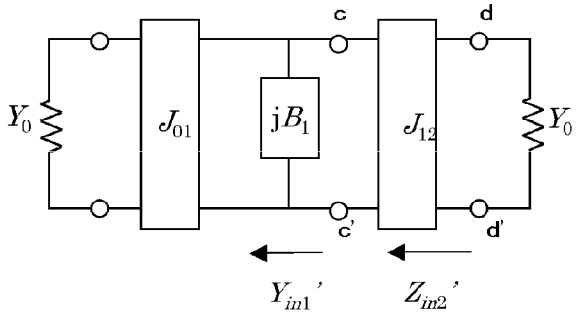
FIG. 6 shows the composition of prototype 1 stage filter.

From equation (19) and equation (20), prototype 1 stage filter is comprised as shown in FIG. 6, and the designed values are given by equation (35). Here, "w" denotes a fractional bandwidth, "b" denotes a susceptance slope parameter and "$g_i$" denotes a normalization device value. In FIG. 6, $Y_{in1}$' is expressed by equation (36) when seen left side from terminal c-c'. Therefore, the impedance $Z_{in2}$' is expressed by equation (37) when seen left side from terminal d-d'.

Equation 14

$$J_{01} = \sqrt{w}\sqrt{\frac{Y_0 b}{g_0 g_1}},\ J_{12} = \sqrt{w}\sqrt{\frac{bY_0}{g_1 g_2}}\quad (g_0 = g_2 = 1) \tag{35}$$

$$Y'_{in1} = \frac{J_{01}^2}{Y_0} + jB = \frac{b_1}{Q_{e1}} + jb\left(\frac{\omega}{\omega_0} - \frac{\omega_0}{\omega}\right) \tag{36}$$

$$Z'_{in2} = \frac{Y_{in}}{J_{12}} = Z_0 + jZ_0 Q_{e2}\left(\frac{\omega}{\omega_0} - \frac{\omega_0}{\omega}\right) \tag{37}$$

In order that the matching circuit of FIG. 5(*c*) can be same with the filter of FIG. 6, it is enough to determine external Q of parallel resonance and J parameter of J inverter so that $Z_{in2}=Z_{in2}$' holds in equation (34) and equation (37). Therefore, designed values are given by equation (38) and equation (39).

Equation 15

$$\frac{b}{G_{in}} = Q_{e2} = \frac{g_0 g_1}{w} \tag{38}$$

$$J = \sqrt{\frac{G_{in}}{Z_0}} = \sqrt{\frac{wb}{Z_0 g_0 g_1}} \tag{39}$$

Then, characteristic impedance $Z_1$ and electric length $\theta_0$ of the transmission line will be derived so that the circuit of FIG.

5(*a*) becomes equivalent to a parallel resonator, and the external Q satisfies equation (38). In the equation (31), a definition of z, r, and x which satisfy equation (40) will lead to input admittance $Y_{in}$ of the circuit of FIG. 5(*a*) expressed by equation (41).

Equation 16

$$z \equiv \frac{Z_a}{Z_1} \equiv r + jx \tag{40}$$

$$\begin{aligned} Z_1 Y_{in} &= \frac{Z_1}{Z_{in}} = \frac{1 + jz\tan\theta}{z + j\tan\theta} \\ &= \frac{\cos\theta + j(r + jx)\sin\theta}{(r + jx)\cos\theta + j\sin\theta} \\ &= \frac{\{(\cos\theta - x\sin\theta) + jr\sin\theta\}\ \{r\cos\theta - j(x\cos\theta + \sin\theta)\}}{(r\cos\theta)^2 + (x\cos\theta + \sin\theta)^2} \end{aligned} \tag{41}$$

Since the susceptance of a parallel resonator becomes zero at center frequency, $\theta_0$ should just be taken as the electric length so that an imaginary part becomes 0 in equation (41). Therefore, $\theta_0$ satisfies equation (42).

Equation 17

$$\tan 2\theta_0 = \frac{2x}{r^2 + x^2 - 1},\ \sin 2\theta_0 = \frac{2x}{\sqrt{(r^2 + x^2 - 1)^2 + (2x)^2}},\ \cos 2\theta_0 = \frac{r^2 + x^2 - 1}{\sqrt{(r^2 + x^2 - 1)^2 + (2x)^2}} \tag{42}$$

Here, when the numerator is replaced by h(θ) and the denominator is replaced by H(θ) in equation (41), h(θ) and H(θ) are expressed by equation (43) and equation (44), using equation (42), respectively.

Equation 18

$$\begin{aligned} h(\theta) &= r(\cos^2\theta + \sin^2\theta) + j[(r^2 + x^2 - 1)\sin\theta\cos\theta - x(\cos^2\theta - \sin^2\theta)] \\ &= r + j\left\{\frac{1}{2}(r^2 + x^2 - 1)\sin 2\theta - x\cos 2\theta\right\} \\ &= r + j\frac{1}{2}\sqrt{(r^2 + x^2 - 1)^2 + (2x)^2}\ (\cos 2\theta_0 \sin 2\theta - \sin 2\theta_0 \cos 2\theta) \\ &= r + j\frac{1}{2}\sqrt{(r^2 + x^2 - 1)^2 + (2x)^2}\ \sin 2(\theta - \theta_0) \end{aligned} \tag{43}$$

$$\begin{aligned} H(\theta) &= (r^2 + x^2)\cos^2\theta + \sin^2\theta + 2x\sin\theta\cos\theta \\ &= \frac{1}{2}(r^2 + x^2 + 1) + \frac{1}{2}(r^2 + x^2 - 1)\cos 2\theta + x\sin 2\theta \\ &= \frac{1}{2}(r^2 + x^2 + 1) + \\ &\quad \frac{1}{2}\sqrt{(r^2 + x^2 - 1)^2 + (2x)^2}\ (\cos 2\theta_0 \cos 2\theta + \sin 2\theta_0 \sin 2\theta) \\ &= \frac{1}{2}(r^2 + x^2 + 1)\frac{1}{2}\sqrt{(r^2 + x^2 - 1)^2 + (2x)^2}\ \cos(\theta - \theta_0) \end{aligned} \tag{44}$$

Therefore, conductance $G_{in}$ at center frequency $\omega_0$ is expressed by equation (45). Here, $x_0$ is a value of x at center frequency, and $x_0 = \omega_0 L_a / Z_1$. Susceptance $B_{in}$ is expressed by equation (46).

Equation 19

$$G_{in}|_{\omega=\omega_0} = \frac{1}{Z_1}\frac{2r}{r^2 + x_0^2 + 1 + \sqrt{(r^2 + x_0^2 - 1) + (2x_0)^2}} \tag{45}$$

$$B_{in} = \frac{1}{Z_1}\frac{\sqrt{(r^2 + x^2 - 1) + (2x)^2}\ \sin 2(\theta - \theta_0)}{r^2 + x^2 + 1 + \sqrt{(r^2 + x^2 - 1) + (2x)^2}\ \cos 2(\theta - \theta_0)} \tag{46}$$

As for equation (46), frequency dependency is given by equation (47). Then, susceptance slope parameter b is given by equation (48). When $d/dx(\tan^{-1}x) = 1/(1+x^2)$ is used, susceptance slope parameter b is expressed by equation (49) based on equation (48).

Equation 20

$$\theta = \omega\sqrt{LC}\,l,\quad x = X_a / Z_1 = \omega L_a / Z_1 \tag{47}$$

$$b = \frac{\theta_0}{2}\frac{\partial B_{in}}{\partial \theta}\bigg|_{\substack{x=x \\ \theta=\theta_0}} + \frac{x_0}{2}\frac{\partial B_{in}}{\partial x}\bigg|_{\substack{x=x \\ \theta=\theta_0}} \tag{48}$$

$$\begin{aligned} (\text{1st term}) &= \frac{\theta_0}{Z_1}\frac{\sqrt{(r^2 + x_0^2 - 1) + (2x_0)^2}}{r^2 + x_0^2 + 1\sqrt{(r^2 + x_0^2 - 1) + (2x_0)^2}} \\ (\text{2nd term}) &= -\frac{x_0}{Z_1}\frac{\sqrt{(r^2 + x_0^2 - 1) + (2x_0)^2}}{r^2 + x_0^2 + 1 + \sqrt{(r^2 + x_0^2 - 1) + (2x_0)^2}}\frac{\partial\theta_0}{\partial x} \\ &= \frac{x_0}{Z_1}\frac{\sqrt{(r^2 + x_0^2 - 1) + (2x_0)^2}}{r^2 + x_0^2 + 1 + \sqrt{(r^2 + x_0^2 - 1) + (2x_0)^2}}\frac{1 + x^2 - r}{(r^2 + x_0^2 - 1) + (2x_0)^2} \end{aligned}$$

$$b = \frac{1}{Z_1}\frac{\sqrt{(r^2 + x_0^2 - 1) + (2x_0)^2}}{(r^2 + x_0^2 + 1) + \sqrt{(r^2 + x^2 - 1) + (2x_0^2)}} \cdot \left(\theta_0 + x_0\frac{1 + x_0^2 - r^2}{(r^2 + x_0^2 - 1) + (2x_0)^2}\right) \tag{49}$$

Using the definition of equation (50) for conductance $G_{in}$, external Q of a resonator can be calculated from equation (45) and equation (49). Since this external Q satisfies equation (38), equation (51) holds.

Equation 21

$$G_{in} \cong G_{in}|_{\omega=\omega_0} \tag{50}$$

$$Q_{e1} = \frac{b}{G_{in}|_{\omega-\omega_0}} = \frac{1}{2r}\sqrt{(r^2 - x_0^2 - 1) + (2x_0)^2} \cdot \left(\theta_0 + \frac{x_0(1 + x_0^2 - r^2)}{(r^2 + x_0^2 - 1) + (2x_0)^2}\right) \tag{51}$$

By solving equation (51) and equation (42) as a set of simultaneous equations, the design formula of $Z_1$ and $\theta_0$ is obtained. Here, $r=R_a/Z_1<<1$ and x holds for a miniaturized antenna. Therefore, equation (42) and equation (51) can be approximated by equation (52) and equation (53), respectively. Equation (54) is obtained from equation (52). If equation (40) is used for equation (53) and equation (54), equation (55) and equation (56) are obtained. Here, $X_a$ is the value at center frequency.

Equation 22

$$\tan 2\theta_0 \approx \frac{2x_0}{x_0^2 - 1} \tag{52}$$

$$Q_{e1} \approx \frac{1}{2r}(x_0^2+1)\cdot\left(\theta_0 + \frac{x_0(x_0^2+1)}{(x_0^2+1)^2}\right) = \frac{1}{2r}[(x_0^2+1)\theta_0 + x_0] \tag{53}$$

$$x_0 = \cot\theta_0 \tag{54}$$

$$Z_1 = X_a \tan\theta_0 \tag{55}$$

$$Q_{e1} = \frac{X_a^2 + Z_1^2}{2R_a Z_1}\theta_0 + \frac{X_a}{2R_a} \tag{56}$$

Figure 7:
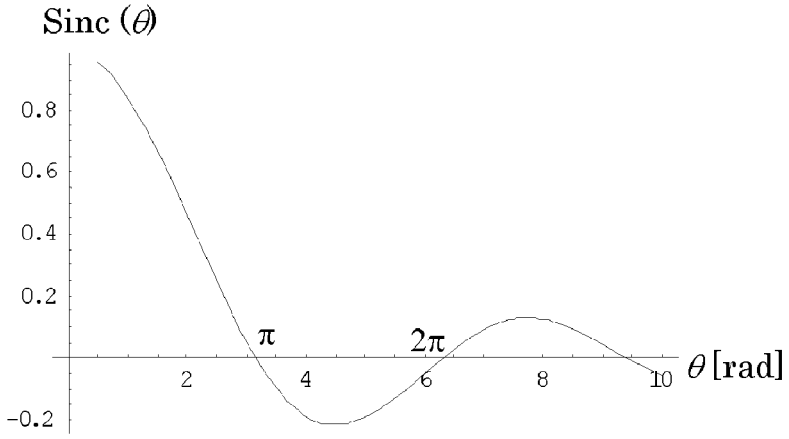
FIG. 7 shows the waveform of function Sinc(θ).

Equation (56) is expressed by equation (57), when equation (54) is substituted and arranged. And when function Sinc(θ)=sin θ/θ is introduced, equation (58) is obtained. Here, since function Sinc(θ) has a waveform as shown in FIG. 7, $Q_{e1}>X_a/2R_a$ must be satisfied in order for $\theta_0$ which fills equation (58) to exist in $0<\theta_0<\theta/2$.

Equation 23

$$Q_{e1} = \frac{X_a}{2R_a}\left(\frac{2\theta_0}{\sin 2\theta_0} + 1\right) \tag{57}$$

$$\theta_0 = \frac{1}{2}\mathrm{Sinc}^{-1}\left(\frac{X_a}{2Q_{e1}R_a - X_a}\right) \tag{58}$$

As mentioned above, the design formula of a matching circuit are given by the equation (55) and the equation (58).

Figure 8:
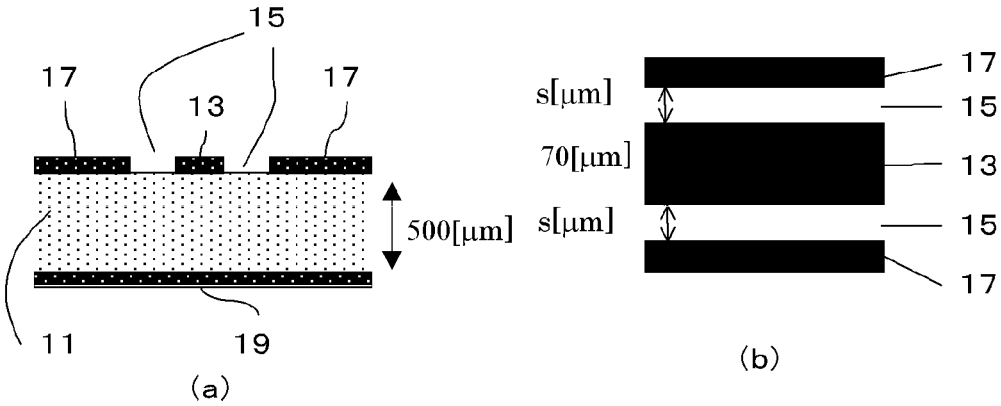
FIG. 8 shows the shape of coplanar waveguide (CPW).

Next, realization of a matching circuit with a coplanar waveguide is described. FIG. 8 is a figure showing an example of the shape of a coplanar waveguide (CPW). In FIG. 8, CPW has a conductor covering a plane of a dielectric body and two slots in parallel with the conductor. The conductor between the two slots is called a central conductor. As for CPW, characteristic impedance is dependent on the width of the central conductor and the gap between conductors. Since its line width can be narrowed if needed, it is effective in the miniaturization of the circuit.

If the thickness of an electrode is assumed to be the infinitesimal, effective dielectric constant $\epsilon_{eff}$ and characteristic impedance $Z_0$ are given by equation (59). When a substrate has a limited thickness h, effective dielectric constant $\epsilon_{eff}$ and characteristic impedance $Z_0$ are given by equation (60). Here, $k_1$ and $k_2$ are expressed by $k_1=a/b$ and $k_2=\sin h(\pi_a/2h)/\sin h(\pi_b/2h)$, respectively. $\epsilon_r$ denotes the relative permittivity of a substrate and K denotes first-sort complete elliptic integral and is approximated by equation (61).

Equation 24

$$\varepsilon_{eff} - \frac{\varepsilon_r + 1}{2},\ Z_0 = \frac{30\pi}{\sqrt{\varepsilon_{eff}}}\frac{K'(k_1)}{K(k_1)} \tag{59}$$

$$\varepsilon_{eff} = 1 + \frac{\varepsilon_r - 1}{2}\frac{K(k_2)}{K(k_2)}\frac{K'(k_2)}{K(k_2)},\ Z_0 = \frac{30\pi}{\sqrt{\varepsilon_{eff}}}\frac{K'(k_1)}{K(k_1)} \tag{60}$$

$$\frac{K(k)}{K'(k)} = \begin{cases} \pi/\ln\left[2\left(1+\sqrt{k'}\right)/\left(1-\sqrt{k'}\right)\right] & (0 \le k \le 0.707) \\ \ln\left[2\left(1+\sqrt{k'}\right)/\left(1-\sqrt{k'}\right)\right]/\pi & (0.707 \le k \le 1) \end{cases} \tag{61}$$

Then, the composition of J inverter using a coplanar waveguide is explained. If the gap of the suitable length is made in the central conductor of a coplanar waveguide, an adjoining central conductor will have capacity and the effect of in-series capacitance is obtained. Capacity also exists between the gap portion of the central conductor and ground, and the effect of parallel capacitance is also considered. Therefore, the gap portion of a coplanar waveguide is considered to be π form circuit of capacitance. If the transmission line of the both ends of a gap is set to electric length Φ/2, a cascade matrix including a transmission line is expressed by equation (62) for characteristics admittance $Y_0$. Here, it is supposed that a transmission line is lossless.

Equation 25

$$\begin{bmatrix} A & B \\ C & D \end{bmatrix} = \tag{62}$$

$$\begin{bmatrix} \cos\frac{\phi}{2} & \frac{j}{Y_0}\sin\frac{\phi}{2} \\ jY_0\sin\frac{\phi}{2} & \cos\frac{\phi}{2} \end{bmatrix}\begin{bmatrix} 1+\frac{B_a}{B_b} & \frac{1}{jB_b} \\ jB_a\left(2+\frac{B_a}{B_b}\right) & 1+\frac{B_a}{B_b} \end{bmatrix}\begin{bmatrix} \cos\frac{\phi}{2} & \frac{j}{Y_0}\sin\frac{\phi}{2} \\ jY_0\sin\frac{\phi}{2} & \cos\frac{\phi}{2} \end{bmatrix}$$

In equation (62), this circuit becomes equivalent to J inverter in the case of A=D=0 and $C/B=J^2$ (for example, K C. Gupta, et al., "Microstrip Lines and Slotlines", Artechhouse, 1996, p.444). In this case, Equation (63) and equation (64) hold. Equation (63) shows that actual Φ/2 becomes negative length. As mentioned above, J inverter is realizable with the gap provided in CPW, and CPW of electric length Φ/2 at the both ends of the gap.

Equation 26

$$\phi = -\tan^{-1}\left(\frac{2B_b}{Y_0} + \frac{B_a}{Y_0}\right) - \tan^{-1}\frac{B_a}{Y_0} \approx -2\left(\frac{B_a}{Y_0} + \frac{B_b}{Y_0}\right) \tag{63}$$

$$\frac{J}{Y_0} = \left|\tan\left(\frac{\phi}{2} + \tan^{-1}\frac{B_a}{Y_0}\right)\right| \approx \left|-\frac{1}{Y_0}(B_a + B_b) + \frac{B_a}{Y_0}\right| = \left|\frac{B_b}{Y_0}\right| \tag{64}$$

An inverter is realizable with the gap provided in the transmission line, and the transmission line having electric length Φ/2 at the both ends of the gap. However, as for the inverter of the first step, the transmission line of electric length Φ/2 at the input side cannot be realized, and it becomes L type inverter. This L type inverter serves as a circuit where a resistance connects with the exterior via an inverter. If input admittance Y of this L type inverter is expressed by equation (65) for internal admittance to $Y_0$ and the parameter of an inverter J. And as for a circuit where internal admittance $Y_0$ and susceptance $B_b'$ are connected in series, and susceptance $B_a'$ is connected to them in parallel, the input admittance Y' of this circuit is expressed by equation (66). Equation (67) is obtained by supposing Y=Y' in equation (65) and equation (66).

Equation 27

$$Y = J^2 Z_0 \tag{65}$$

$$Y' = \frac{B_b'^2 Y_0 + j(B_b' Y_0^2 - B_b'^2 B_a'^2 - B_a'^2 Y_0^2)}{B_b'^2 + Y_0^2} \tag{66}$$

$$\frac{J^2}{Y_0} = \frac{B_b'^2 Y_0}{B_b'^2 + Y_0^2} \tag{67}$$

Here, in order that J parameter of L type inverter equals $B_b'$, this J parameter should be the value expressed by equation (68).

Equation 28

$$J = \frac{J_{01}}{\sqrt{1 - (J_{01} Z_0)^2}} \tag{68}$$

Then, the design of the miniaturized antenna with impedance matching circuit using an electromagnetic field simulator is explained. The electromagnetic field simulator used for the design calculates the S parameter of general planar circuits, such as a micro stripe, a slot line, a strip line, and a coplanar line, based on method of moments. As for the setup of this simulation, a center frequency is 5.0 GHz, Mesh Frequency is 7.5 GHz, and the number of cells per wave is 30.

By equation (38), it is required for the value of external Q of a resonance part to be small to realize a large fractional bandwidth by an impedance-matching circuit. The value of external Q can be lowered by lowering the value of impedance $Z_1$. In addition, in order to enlarge radiation resistance, it is necessary to take the shape of an antenna section into consideration.

First, CPW is analyzed. FIG. 8 is a figure showing the shape of CPW used this time. FIG. 8(*a*) is a figure showing the structure of a cross-section, and FIG. 8(*b*) is a figure showing its top view. With reference to FIG. 8(*a*), CPW is provided by forming central conductor 13 and slot 15 at its both sides on the top of dielectrics 11. The other parts 17 on the top of dielectrics 11 and the part 19 under dielectrics 11 are grounds. Here, dielectrics 11 are MgO (relative permittivity 9.6), and its thickness is 500 [μm]. With reference to FIG. 8(*b*), the width of central conductor 11 is 70 [μm], and let the width of slot 13 be s [μm]. Since the substrate is thick enough compared with the central conductor width, characteristic impedance $Z_1$ is almost the same with that of the case where there is no ground. Therefore, characteristic impedance can be theoretically approximately obtained from equation (61). However, in order to acquire a more exact value, $Z_1$ is analyzed by an electromagnetic field simulation. The S matrix obtained from the simulation is transformed into cascade matrix K, and $Z_1$ is calculated by equation (69) from its [1, 1] component and [1, 2] component.

Equation 29

$$Z_1 = \frac{K_{12}}{\sqrt{K_{11}^2 - 1}} \tag{69}$$

Next, the method of computing phase constant β by an electromagnetic field simulation is explained. Since the S matrix of the lossless transmission line of length 1 can be expressed by equation (70), β can be calculated by equation (71) from [2, 1] component of the S matrix obtained from the simulation.

Equation 30

$$S = \begin{bmatrix} 0 & e^{j\gamma l} \\ e^{-j\gamma l} & 0 \end{bmatrix} \tag{70}$$

$$\beta = \mathrm{Im}\gamma = \mathrm{Im}\left(\frac{-\ln S_{21}}{l}\right) \tag{71}$$

Figure 9:
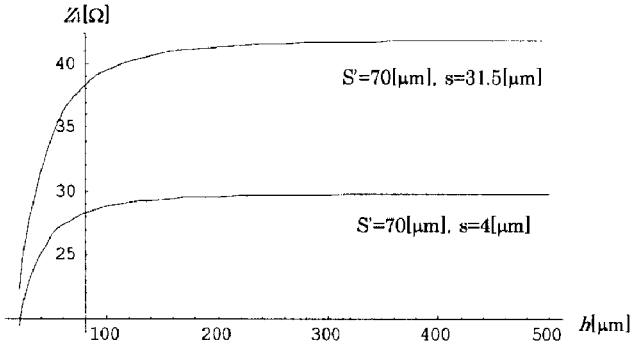
FIG. 9 shows change of characteristic impedance $Z_1$ in the case of using the substrate of another thickness.

In order to lower the value of external Q, small characteristic impedance of CPW is desirable. FIG. 9 is a figure showing the change of characteristic impedance $Z_1$ in the case of using the substrate of another thickness, which is obtained by equation (60). When the ratio of substrate thickness to central conductor width $h/Z_1$ is more than two, characteristic impedance is hardly affected by a back conductor and keeps almost constant. When the ratio $h/Z_1$ is smaller than 1, characteristic impedance goes small as substrate thickness becomes thin.

Then, a miniaturized slot antenna is analyzed. The miniaturized slotted dipole antenna of FIG. 2(*a*) was used as an antenna section this time. As shown in FIG. 2(*b*), inclination of radiation resistance $R_a$ and reactance $X_a$ of this antenna becomes constant near center frequency. Therefore, as shown in FIG. 2(*c*), the equivalent circuit of the antenna section can be expressed by the series circuit of radiation resistance Ra and reactance $X_a$, and the matching theory mentioned above can be applied.

Figure 10:
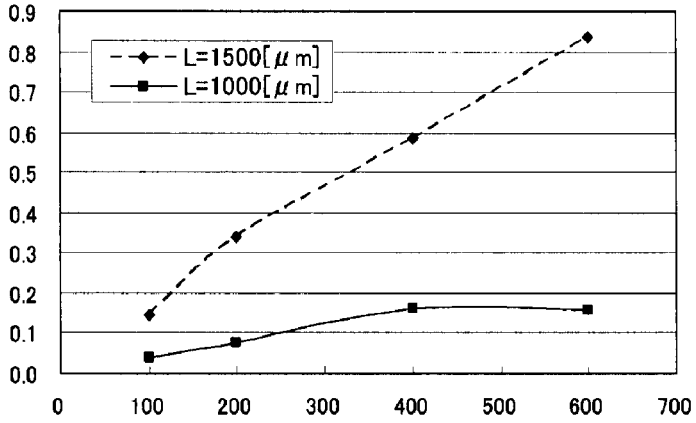
FIG. 10 shows the simulation result of radiation resistance $R_a$ when changing antenna width W under the condition that antenna length L and characteristic impedance $Z_1$ of CPW is constant.

There is a limit to the value of the characteristic impedance of CPW. Therefore, in order to increase the fractional bandwidth w, it is necessary to raise radiation resistance $R_a$ of an antenna to some extent. FIG. 10 is a figure showing the simulation result of radiation resistance $R_a$ when setting antenna length L constant at 1000 [μm] or 1500 [μm], setting characteristic impedance $Z_1$ of CPW to 50 [Ω], and changing antenna width W. The horizontal axis expresses antenna width and the vertical axis shows radiation resistance. As shown in FIG. 10, radiation resistance increases as the antenna width spreads.

Then, the design method of J inverter is explained. As mentioned above, J inverter can be realized by the gap provided in the signal line, and CPW of electric length Φ/2 at the right and left side of the gap. The shape of the gap has two kinds, a simple gap and an interdigital gap, which can be selected according to the desirable value of J parameter. Since big J parameter was needed, the interdigital gap was adopted this time. The equivalent circuit of J inverter using an interdigital gap differs from the case of a simple gap. The equivalent circuit has an ambiguous boundary between the discontinuous part of a transmission line and a pure transmission line. Therefore, π type circuits of susceptance $B_a$ and $B_b$ concentrate on the center line of a gap, and the transmission line of electric length Φ/2 are added to the right and left.

Since Φ/2 is negative electric length, J inverter is designed by the following methods. Suppose the circuit where the transmission line of characteristic impedance $Z_1$ and electric length θ are connected to the both ends of an inverter. If θ is about π/2 by weak combination ($J/Y_1 \ll 1$), the cascade matrix between the both ends of this circuit is expressed by equation (72). By replacing with $-Z_1 \sin\theta = X$, the cascade matrix can be expressed by equation (73). Here, X=0 when there is no diffrence between a resonance point and center frequency. Therefore, J inverter can be designed by changing the S matrix obtained by the simulation into a cascade matrix, and by adjusting the line length of the both ends of the gap so that the [1, 1], and [2, 2] components become 0, the design of J inverter can be performed. J parameter is given as the [2, 1] component of the cascade matrix.

Equation 31

$$[K] = \begin{bmatrix} \cos\theta & jZ_1\sin\theta \\ jY_1\sin\theta & \cos\theta \end{bmatrix} \cdot \begin{bmatrix} 0 & -jK \\ -jJ & 0 \end{bmatrix} \cdot \begin{bmatrix} \cos\theta & jZ_1\sin\theta \\ jY_1\sin\theta & \cos\theta \end{bmatrix} = \begin{bmatrix} -JZ_1\theta\sin\theta & jJZ_1^2\sin^2\theta - jK \\ -jJ & -JZ_1\sin\theta \end{bmatrix} \left(\because \frac{K}{Z_1} \ll 1\right) \tag{72}$$

$$[K] = \begin{bmatrix} JX & -jK + jJX^2 \\ -jJ & XJ \end{bmatrix} \tag{73}$$

Then, the design of a miniaturized antenna with impedance matching circuit is explained. First, the analysis of external Q of a resonator is explained.

Parallel resonance can be realized by adjusting the length of the transmission line connected to the antenna. A band design is performed by adjusting so that external Q of this resonator may fill equation (38).

External Q is expressed theoretically by equation (51) based on the circuit model. When an antenna is small, the value of $R_a$ obtained from the analysis of the antenna section is unreliable. Therefore, there may be some difference between a circuit model and an electromagnetic field simulation. Therefore, it is necessary to calculate external Q correctly by a simulation. External Q is computable from conductance $G_{in}$ and susceptance parameter b around resonance point, obtained from the simulation. When an antenna is small, conductance $G_{in}$ becomes a very small value. Therefore, we use the following method in order to compute external Q more correctly.

Letting the external Q of a resonator being $Q_e$, input admittance $Z_{in}$ is expressed with equation (74). Then, the value of $|Z_{in}|^2$ is expressed by equation (75). Therefore, external Q is obtained from equation (76) for frequencies $\omega_1$ and $\omega_2$ where the value of $|Z_{in}|^2$ is half of that at center frequency. What is necessary is just to design so that this external Q fills equation (38).

Equation 32

$$Z_{in} = \frac{1}{\frac{b}{Q_e} + jb\left(\frac{\omega}{\omega_0} - \frac{\omega_0}{\omega}\right)} \approx \frac{1}{b\left(\frac{1}{Q_e} + j\frac{\Delta\omega}{\omega_0}\right)} \tag{74}$$

$$|Z_{in}|^2 = \frac{1}{b^2\left(\frac{1}{Q_e^2} + \left(\frac{\Delta\omega}{\omega_0}\right)^2\right)} \tag{75}$$

$$\omega_1 - \omega_2 = \Delta\omega = \frac{1}{Q_e} \tag{76}$$

Figure 11:
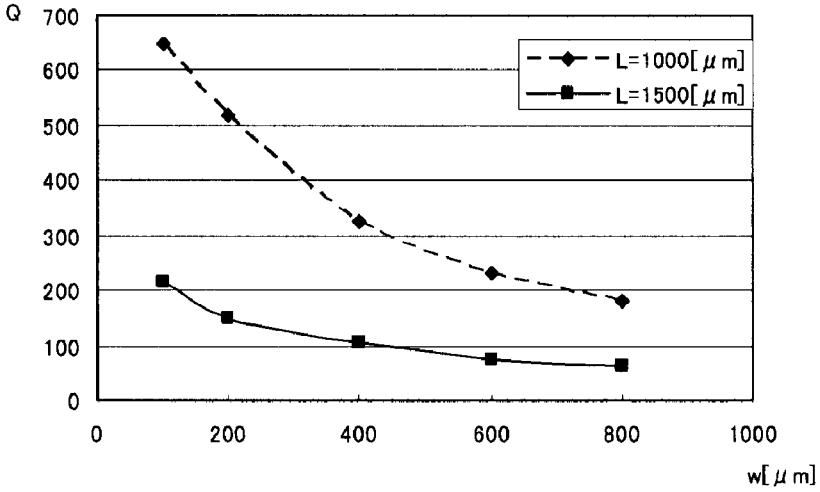
FIG. 11 shows the simulation result of the value of external Q when changing antenna width W under the condition that antenna length L and characteristic impedance $Z_1$ of CPW is constant.

FIG. 11 is a figure showing the simulation result of the value of external Q, obtained from the above method, when changing antenna width W keeping antenna length L constant at 1000 [μm] or 1500 [μm] and letting characteristic impedance $Z_1$ of CPW being 50 [Ω]. The horizontal axis is antenna width and the vertical axis is external Q. If the width of an antenna is expanded, then radiation resistance goes up, resulting in the smaller value of external Q.

Then, the design of a matching circuit is explained. The antenna of length 1500 [μm] and width 600 [μm] is designed under the condition of the number of section n=1, reflection coefficient $RL_r$=3 dB, and fractional bandwidth w=4.0%. In this case, a normalization device value is calculated as $g_0=g_2=1$ and $g_1=2.0049$ from equations (5)-(7). For the parallel resonance obtained at the characteristic impedance of CPW 29.9 [Ω] and the length of CPW, $L_{CPW}$, of 3140 [μm], conductance $G_{in}$, susceptance parameter b and external Q at the center frequency are calculated to be 0.000441 [s], 0.0221 and 50.06, respectively.

By using equation (39), the designed value of J parameter is acquired from conductance $G_{in}$. Although J inverter is designed with the aforementioned design method, since the inverter of a first step does not have a transmission line at the input side, it is necessary to perform adjustment of J parameter and resonator length. J inverter is attached to a parallel resonant circuit, and the length of the transmission line is adjusted so that series resonance is obtained when seen from the outside. What is necessary is just to make the reactance component of input impedance $Z_{in2}$ set to 0 at the center frequency. And gap length G of J inverter is adjusted so that $Z_{in2}$ equals to $Z_0$ (=50 [Ω]). As a result, electric length θ=2925 [μm] and gap length G=315 [μm] were obtained.

Although a miniaturized antenna with a matching circuit can be designed as mentioned above, miniaturization is difficult if the transmission line has a shape of a straight line because the whole length of the antenna is long. Then, a transmission line is bent to form a meander shape. When a transmission line is made into meander shape, the susceptance parameter of the resonant circuit changes. And also, J parameter of the inverter changes a little. Therefore, the resonance length and the gap length of J inverter should be adjusted similarly as the above. As a result, the gap length G was calculated to be G=290 [μm].

Figure 12:
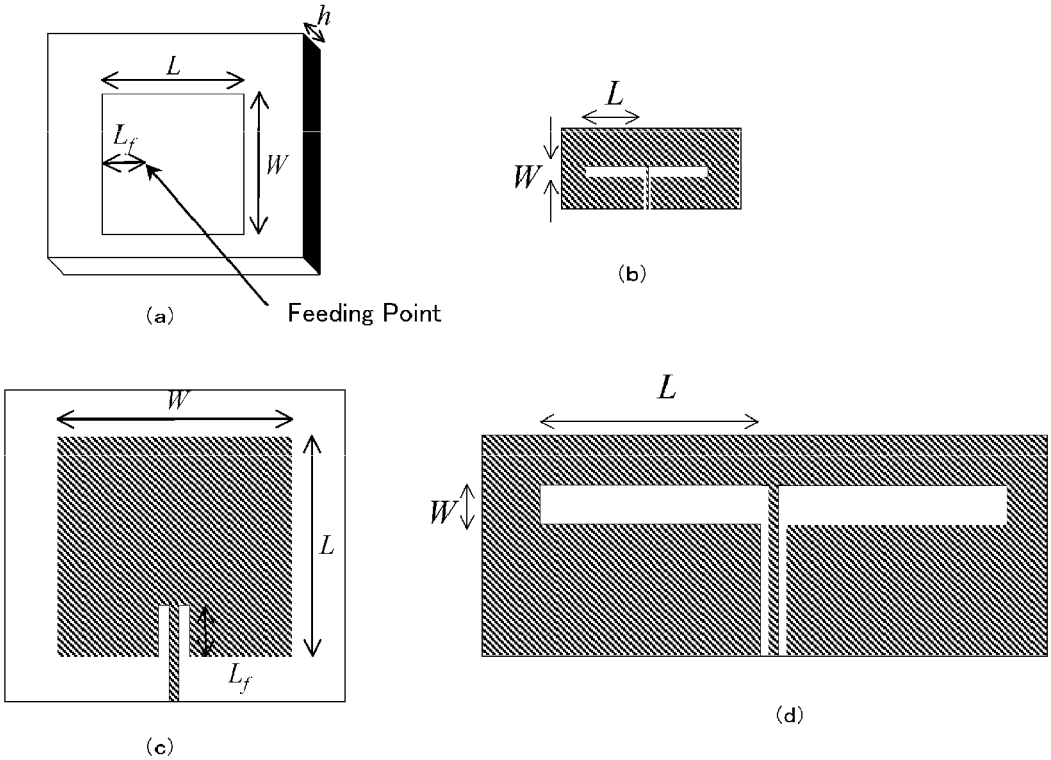
FIG. 12 is a comparison figure of antenna size.

In FIG. 12, the antenna sizes are compared between the method mentioned above and the conventional method. As shown in FIG. 12(*a*), the substrates of thickness h being 0.5 [mm] and the substrate material being MgO (dielectric constant $\epsilon_r$=9.6) were used. L is antenna length, W is antenna width and $L_f$ is the distance from the antenna to a feeding point. FIG. 12(*b*) is a figure showing the miniaturized dipole antenna designed based on the design method described above. The character of the antenna is: center frequency $f_0$=5.0 GHz, reflection coefficient $RL_r$=3 dB and a fractional bandwidth w=4.0% and the number of step n=1. The length of the antenna L is 1.5 [mm] (the whole length is 3.0 [mm]) and width W of the antenna is 0.6 [mm]. FIG. 12(*c*) is a figure showing a one-wave length slot antenna. Antenna length L is 14.1 [mm] (the whole length is 28.2 [mm]), and antenna width is 1.0 [mm]. FIG. 12(*d*) shows a patch antenna. Both antenna length L and antenna width W are 9.7 [mm]. The antenna areas of a conventional antenna and the antenna of the present invention were compared. Significant miniaturization is achieved: about 1/16 for a one-wave slot antenna and about 1/52 for a patch antenna. Since the size of a communication circuit is greatly dependent on the size of its antenna. Therefore, the design method of the present invention can realize the miniaturization of the whole communication circuit.

Figure 13:
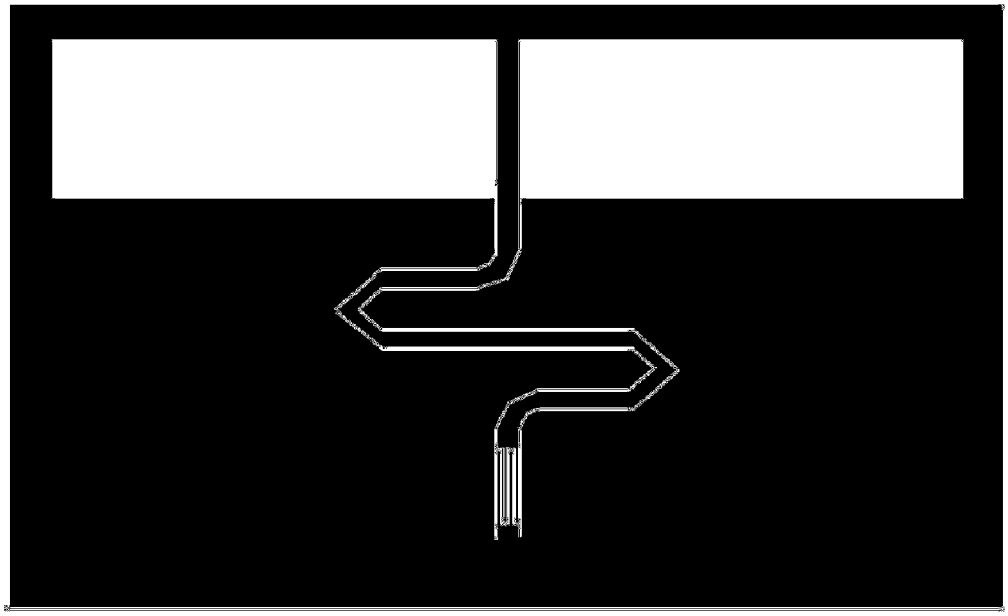
FIG. 13 shows the miniaturized slot antenna with a designed matching circuit.

FIG. 13 is a figure showing the appearance and the size of the miniaturized slot antenna with a matching circuit designed with the design method of the present invention. The antenna of FIG. 13 has the following characteristics. The center frequency $f_0$=5.0 GHz, a reflection coefficient $RL_r$=3 dB and a fractional bandwidth w=4.0% and the number of step n=1.

Figure 14:
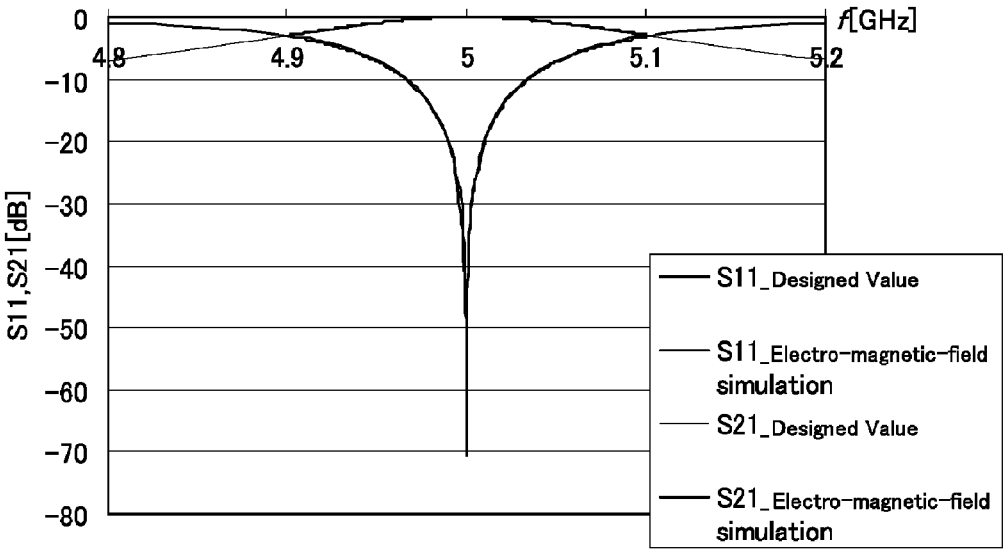
FIG. 14 shows the analysis of the reflection coefficient and a transmission coefficient of the antenna of FIG. 13, output by the simulation.

FIG. 14 is a figure showing the analysis output based on the simulation of the reflection coefficient and transmission coefficient of the designed antenna. A horizontal axis expresses frequency and a vertical axis shows a reflection coefficient and a transmission coefficient. However, since the simulation is performed in one port, only a reflection coefficient is obtained as analysis output. The transmission coefficient of FIG. 14 is calculated by assuming the conductor loss to be 0 and by $|S_{11}|^2+|S_{21}|^2=1$. The simulation result is mostly in accord with the designed value. Input impedance is 50.2 [Ω] at center frequency for radiation resistance Ra=0.837 [Ω]. Matching was possible even when the rate of impedance conversion was very large.

The designed antenna has the similar directivity with a magnetic current dipole. The magnetic current is also similar and flows through the right and left slot in the same direction, and is considered to operate as a magnetic current dipole.

In the design method described so far, the number of element n=1 is assumed. However the design is also possible for the number of steps of two or more.

An impedance-matching circuit can be designed for the antenna called parallel nonresonant as well as for in-series nonresonant. Below, the outline is explained.

Figure 15:
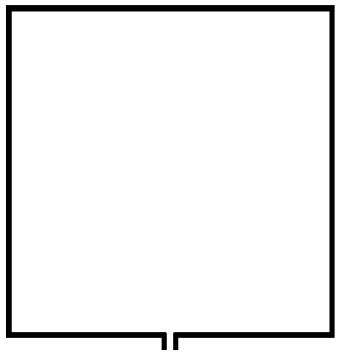
FIG. 15 shows another example of the antenna section of FIG. 1.

FIG. 15 is a figure showing another example of antenna section 3 of FIG. 1. As for the antenna of FIG. 15, an equivalent circuit is expressed with the parallel circuit of internal conductance $G_a$ and internal capacitance $C_a$. This antenna has an open point and is called parallel nonresonant.

Figure 16:
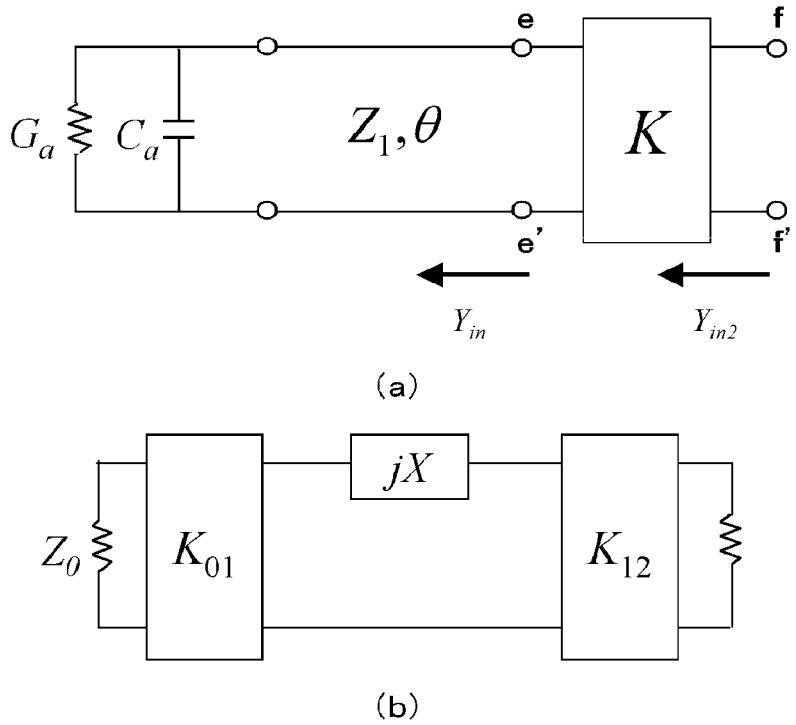
FIG. 16 shows the antenna equivalent circuit with a matching circuit of FIG. 15, and the circuit based on filter theory.

FIG. 16(*a*) is a figure showing the circuit which connected K inverter to the antenna equivalent circuit with a matching circuit. In FIG. 16(*a*), impedance matching circuit is composed of lossless transmission line which has characteristic impedance ($Z_1$) and electrical length θ. Then, the input admittance $Y_{in}$ seen from terminal e-e' is expressed by equation (78). Here, internal admittance $Y_a$ is $Y_a=G_a+j\omega C_a$. And electric length θ fills the relation of equation (47) for ω, L, C, and I. And the input impedance $Z_{in}$ seen from terminal e-e' is expressed by equation (78) for resonance electric length $\theta_0$. Here, $R_{in}$ is internal resistance and x is a reactance slope parameter.

Equation 33

$$Y_{in} = Y_1 \frac{Y_a + jY_1 \tan\theta}{Y_1 + jY_a \tan\theta} \tag{77}$$

$$Z_{in} = R_{in} + jx\left(\frac{\omega}{\omega_0} - \frac{\omega_0}{\omega}\right) \tag{78}$$

In FIG. 16(*a*), in view of terminal f-f', K inverter is inserted in the resonant circuit and the input admittance $Y_{in2}$ is expressed by equation (79).

Equation 34

$$Y_{in2}\frac{Z_{in}}{K^2} = \frac{R_{in}}{K^2} + j\frac{x}{K^2}\left(\frac{\omega}{\omega_0} - \frac{\omega_0}{\omega}\right) \tag{79}$$

On the other hand, FIG. 16(*b*) is a figure showing the circuit including a filter. The designed value of this filter is expressed by equation (80), where g is a normalization device value which can be obtained by equation (5).

Equation 35

$$K_{01} = \sqrt{w}\sqrt{\frac{Z_0 x}{g_0 g_1}},\ K_{12} = \sqrt{w}\sqrt{\frac{Z_0 x}{g_1 g_2}} \tag{80}$$

In this circuit, when left-hand side is seen from terminal e-e', the input impedance $Z_{in}'$ is expressed by equation (81). Therefore, the input admittance $Y_{in2}'$ when left-hand side is seen from terminal f-f' is expressed by equation (82).

Equation 36

$$Z_{in}' = \frac{K_{01}^2}{Z_0} + jX = \frac{x}{Q_{e1}} + jx\left(\frac{\omega}{\omega_0} - \frac{\omega_0}{\omega}\right) \tag{81}$$

$$Y_{in2}' = Y_0 + jY_0 Q_{e2}\left(\frac{\omega}{\omega_0} - \frac{\omega_0}{\omega}\right) \tag{82}$$

What is necessary is just to calculate external Q of resonance and K parameter of K inverter in equation (79) and equation (82), so that $Y_{in2}=Y_{in2}'$ holds. As a result, the designed values are given by equation (83) and equation (84).

Equation 37

$$Q_e = \frac{x}{R_{in}} \tag{83}$$

$$K = \sqrt{\frac{R_{in}}{Y_0}} \tag{84}$$

Then, the characteristics admittance $Y_1$ and the electric length $\theta_0$ of the transmission line are derived so that the circuit when the left side is seen from terminal e-e' in FIG. 16 is equivalent to a resonator and that the external Q fills equation (83).

In equation (77), when g and b are defined by equation (85), electric length $\theta_0$, derived similarly with equation (42), fills equation (86). The input reactance $X_{in}$ and the internal resistance $R_{in}$ are expressed by equation (87) based on the calculation similar with equation (45) and equation (46). The reactance slope parameter x is expressed by equation (88) based on the calculation similar with equation (49).

Equation 38

$$y \equiv \frac{Y_a}{Y_1} \equiv g + jb \tag{85}$$

$$\tan 2\theta_0 = \frac{2b}{g^2 + b^2 - 1} \tag{86}$$

$$\begin{cases} X_{in} = \dfrac{\sqrt{(g^2+b^2-1)^2 + (2b)^2 \sin 2(\theta-\theta_0)}}{Y_1\left[g^2+b^2+1+\sqrt{(g^2+b^2-1)^2+(2b)^2}\cos 2(\theta-\theta_0)\right]} \\ R_{in} = \dfrac{2g}{Y_1\left[g^2+b^2+1+\sqrt{(g^2+b^2-1)^2+(2b)^2}\cos 2(\theta-\theta_0)\right]} \end{cases} \tag{87}$$

$$X = \frac{1}{Y_1}\frac{\sqrt{(g^2+b^2-1)^2+(2b)^2}}{g^2+b^2+1+\sqrt{(g^2+b^2-1)^2+(2b)^2}} \times \left(\theta_0 - b\frac{g^2+b^2-1}{(g^2+b^2-1)^2+(2b)^2}\right) \tag{88}$$

For the external Q, equation (89) is obtained by deriving similarly with equation (51).

Equation 39

$$\begin{aligned} Q_{e1} &= \frac{x}{R_{in}|_{\theta=\theta_0}} \\ &= \frac{1}{2g}\sqrt{(g^2+b^2-1)^2+(2b)^2} \times \left(\theta_0 - \frac{b(1+b^2-g^2)}{(g^2+b^2-1)^2+(2b)^2}\right) \end{aligned} \tag{89}$$

By solving equation (89) and equation (88) as a set of simultaneous equations, the design formulas of $Y_1$ and $\theta_0$ are obtained. Here, since g<<1, b holds for a miniaturized antenna, equation (88) and equation (89) are converted into equation (90) and equation (91), respectively.

Equation 40

$$\tan 2\theta_0 = \frac{2b_0}{b_0^2 - 1} \tag{90}$$

$$Q_{e1} \cong \frac{1}{2g_0}[(b_0^2+1)\theta_0 + b_0] \tag{91}$$

Equation (92) is drawn by converting equation (90) and equation (91) using equation (85).

Equation 41

$$Y_1 = Y_a \tan\theta_0,\ \theta_0 = \frac{1}{2}\mathrm{Sinc}^{-1}\left(\frac{B_a}{2Q_{e1}G_a - B_a}\right) \tag{92}$$

Finally, the design formula of a matching circuit is given by equation (92).

Figure 17:
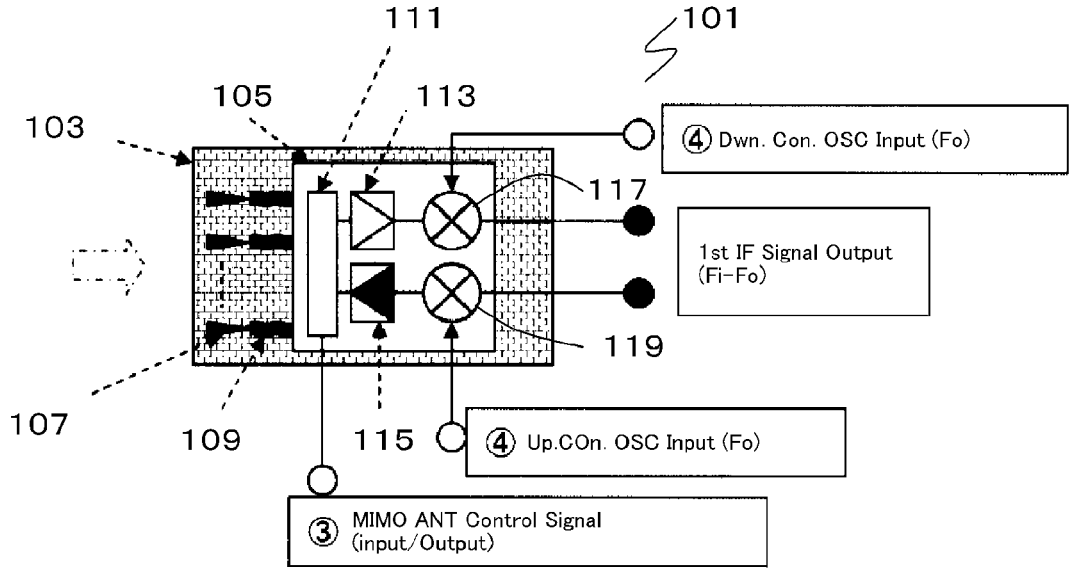
FIG. 17 shows one embodiment of the application to MIMO communication technology.

The embodiment of the present invention can be applied, for example, to MIMO (Multi Input Multi Output) communication technology. FIG. 17 is a figure showing communication circuit 101 using MIMO communication technology. Communication circuit 101 is provided with substrate 103 and semiconductor part 105 which is a part on substrate 103. In this example, substrate 103 is made of high dielectric ceramics and semiconductor part 105 is made of SiGe. In order to realize MIMO communication technology, two or more miniaturized antennas of the same frequency are arranged. In FIG. 17, on substrate 103, two or more antennas 107 and matching circuits 109 are arranged. Semiconductor part 105 includes Multi-antenna control circuit 111, LNA 113, PA 115, mixer 117, and mixer 119. Multi-antenna control circuit 111 controls antennas based on the MIMO_ANT control signal (input and output) given from the exterior. LNA 113 and PA 115 output a 1st_IF signal via mixer 117 and mixer 119, respectively (Fi-Fo). Mixer 117 and mixer 119 operate at the input of Dwn.Con.OSC (Fo) and Up.Con.OSC (Fo) which are given from the exterior, respectively. Since an antenna can be miniaturized according to the present invention, as compared with the antenna of other methods, two or more antennas at the same frequency can be easily placed in a narrow area. Therefore, two or more antennas can be installed on devices such as radio equipment or a card, which can respond to the needs based on next-generation high-speed wireless data transmission.

Figure 18:
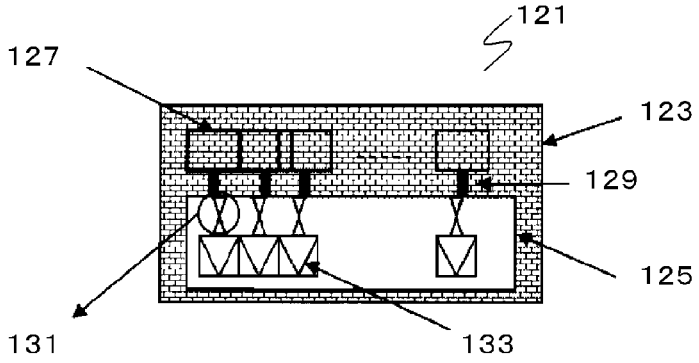
FIG. 18 shows one embodiment of the application to UWB method communication.

As another embodiment of the present invention, for example, the application to UWB (Ultra Wideband) method communication is possible. It is impossible to cover a wide band (3 GHz-7 GHz) with a single antenna. Therefore, it is necessary to cover the wide band by putting two or more antennas corresponding to different wavelengths, which is UWB method communication. FIG. 18 is a figure showing communication circuit 121 which performs UWB method communication. Communication circuit 121 is provided with substrate 123 and semiconductor part 125 provided in substrate 123. On substrate 123, two or more antennas 127 and CPW filters 129 are arranged. Semiconductor part 125 is provided with two or more CPWs 131 and stagger amplifiers 133 with CPWs, corresponding to antennas 127 and CPW filters 129. Communication circuit 121 covers the wide band with CPW filter 129 and with two or more miniaturized antennas 127 connected to device 125 having impedance-matching function. Communication circuit 121 communicates in a UWB method with small multi-antennas in cooperation with plural amplifiers on semiconductor 125 which suppresses the troubles such as oscillation occurred from phase differences by controlling phases digitally.

As another embodiment of the present invention, the application to RFID or a noncontact IC card is possible. Since the size of the whole device depends greatly on the size of an antenna, the present invention which can miniaturize an antenna suits these devices. In particular, the present invention can miniaturize the whole device further by using CPW and meander structure, which make the present invention more adequate for these devices.

Figure 19:
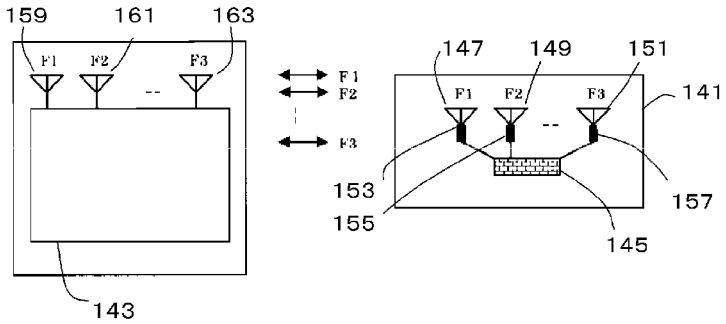
FIG. 19 shows an example of the simultaneous transmissive communication using two or more frequencies.

As another embodiment of the present invention, plural miniaturized antennas may contribute to simultaneous transmissive communication in a plural number of frequencies. For example, the communication of simultaneous and both directions or the communication of one way and transmitting different information on different frequencies are possible. FIG. 19 is a figure showing an example of the simultaneous transmissive communication in plural frequencies. Terminal 141, such as a card, performs the simultaneous transmissive communication with main system 143 in plural frequencies. Terminal 141 includes semiconductor part 145 which processes and plural antennas 147, 149 and 151 and CPW 153, 155 and 157 corresponding to plural frequencies. Main system 143 includes plural antennas 159, 161, and 163 corresponding to plural frequencies. It becomes possible to communicate simultaneously on plural frequencies by realization of a miniaturized antenna and plural matching (filters) based on CPW. Thereby, in RFID or a noncontact IC card, for example, the number of times to carry out data authentication can be reduced by communicating two or more times. Safety improvement is also possible by distributed communication of a security code.

As another embodiment of the present invention, it is also possible to provide a communication circuit including two or more matching circuits with different center frequencies corresponding to different frequency bands. Such a circuit can adjust its channels to the different frequency bands or cover wide band width.

Figure 20:
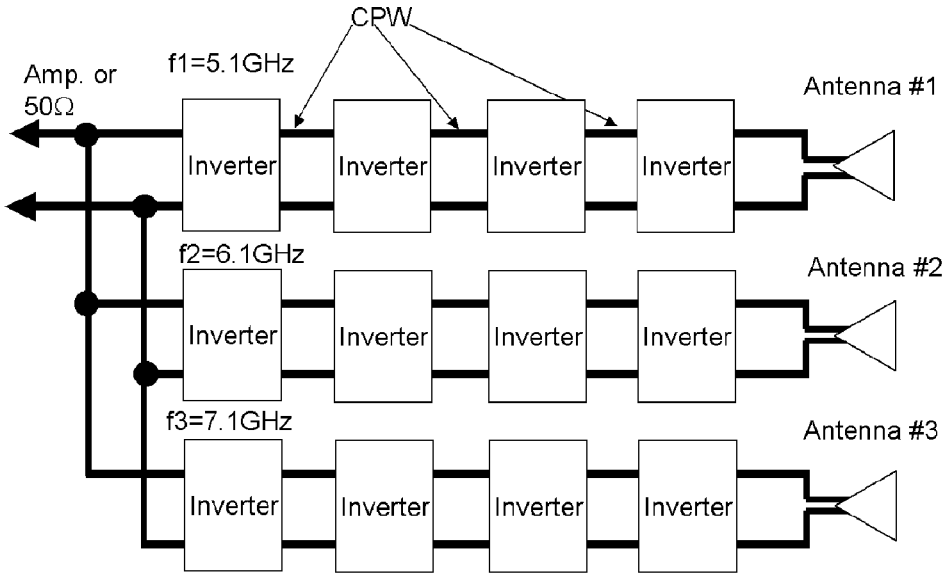
FIG. 20 is a circuit diagram showing the state of connecting each of three steps of band pass filter integral-type coplanar waveguide (CPW) matching circuits to each of three antennas to make the three antennas correspond to three channels.

FIG. 20 is a circuit diagram showing the state of connecting each of three steps of band pass filter integral-type coplanar waveguide (CPW) matching circuits to each of three antennas, and making three channels corresponding.

In FIG. 20, center frequency f1 of the band pass filter and a matching circuit corresponding to antenna #1 is 5.1 GHz (100 MHz of bands). Center frequency f2 of the band pass filter and a matching circuit corresponding to antenna #2 is 6.1 GHz (100 MHz of bands). Center frequency f3 of the band pass filter and a matching circuit corresponding to antenna #3 is 7.1 GHz (100 MHz of bands).

Figure 21:
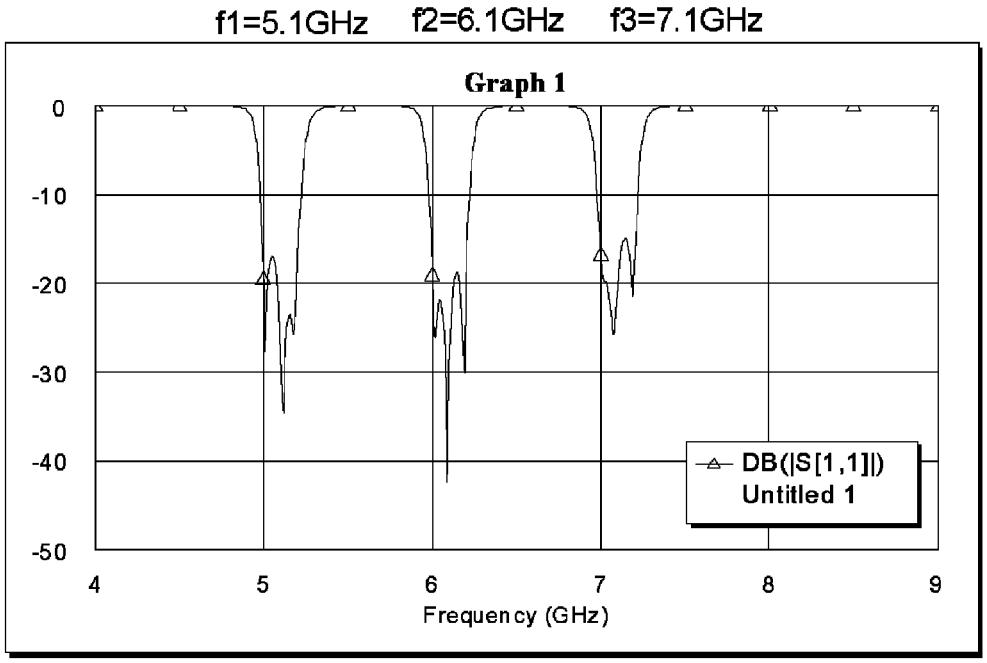
FIG. 21 shows the result of the simulation based on the circuit diagram of FIG. 20.

FIG. 21 is a figure showing the result of having performed the simulation based on the circuit diagram of FIG. 20. From this figure, it is clear that, in the communication device obtained from the circuit diagram of FIG. 20, plural frequency bands which can be used for transmission and reception are obtained with the filter which the frequency band was distinguished without overlapping mutually and was set up. The obtained plural frequency bands may be used for transmission only, for reception only, or partly for transmission and the others for reception.

Figure 22:
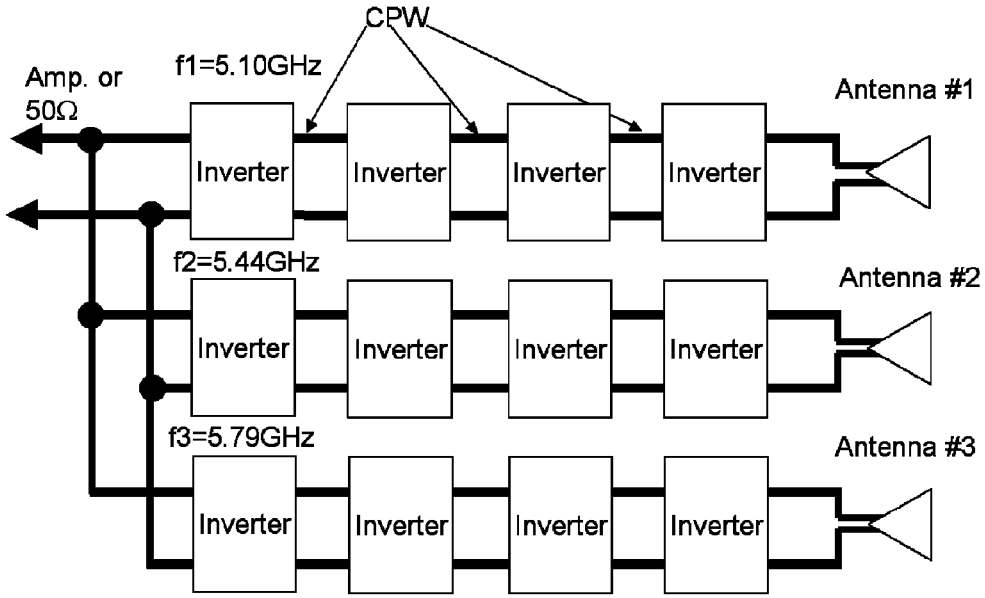
FIG. 22 is a circuit diagram showing the state where connected each of three steps of band pass filter integral-type coplanar waveguide (CPW) matching circuits to each of three antennas in order to broaden 5 GHz bands.

FIG. 22 shows the circuit which connected each of three steps of band pass filters integral-type coplanar waveguide (CPW) matching circuits to each of three antennas. The object of this circuit is broadening of 5 GHz bands.

In FIG. 22, center frequency f1 of the band pass filter and a matching circuit corresponding to antenna #1 is 5.10 GHz (100 MHz of bandwidth). Center frequency f2 of the band pass filter and a matching circuit corresponding to antenna #2 is 5.44 GHz (100 MHz of bandwidth). Center frequency f3 of the band pass filter and a matching circuit corresponding to antenna #3 is 5.79 GHz (100 MHz of bandwidth).

Figure 23:
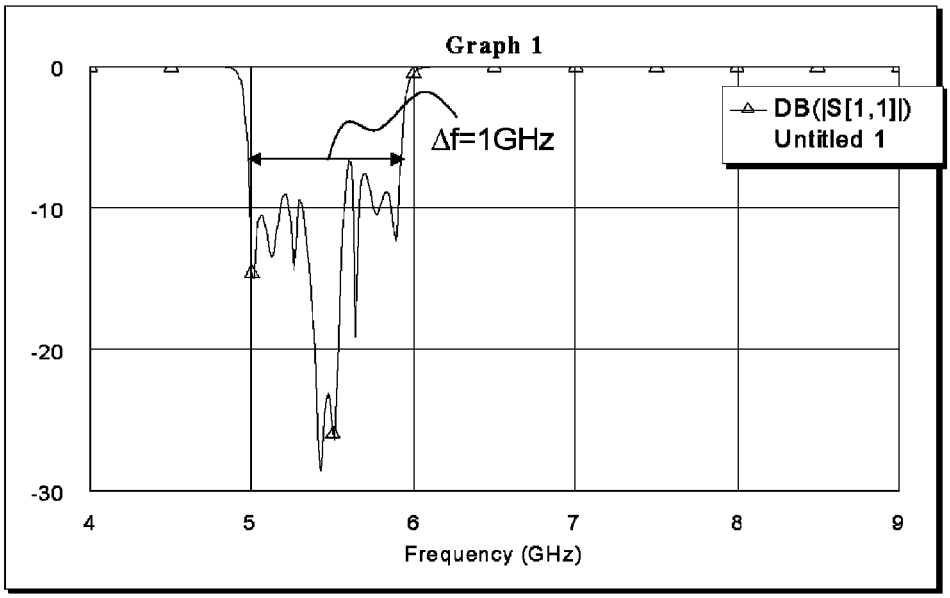
FIG. 23 shows the result of the simulation based on the circuit diagram of FIG. 22.

FIG. 23 is a figure showing the result of having performed the simulation based on the circuit diagram of FIG. 22. From this figure, it is clear that, in the communication device obtained from the circuit diagram of FIG. 22, the frequency band of the bandwidth which amounts to 1 GHz which can be used for transmission and reception can be obtained with the filter of wide bandwidth realized by overlapped plural frequency bands. The obtained frequency band may be used for transmission only or for reception only.

Figure 24:
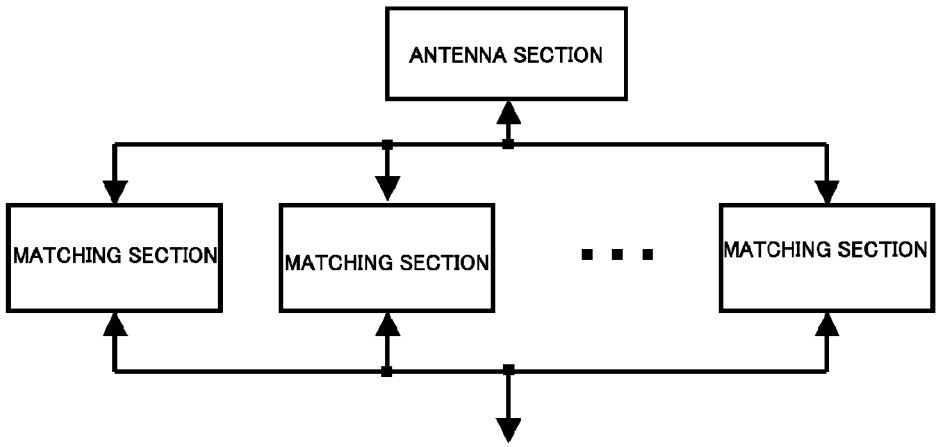
FIG. 24 shows another example of a circuit having two or more matching circuits.

Plural matching circuits maybe corresponding to plural antennas. Or, as shown in FIG. 24, plural matching circuits may be connected to one antenna. Or, both of them may be included.

Here, the feature of the communication device obtained from FIG. 20 through FIG. 24 is summarized as follows.

It is a communication device provided with plural matching circuits linked to an antenna. At least two frequency bands by matching circuits with neighboring center frequencies among the plural matching circuits are either set distinctly from one another without overlapping to make it possible to input signals of different frequencies to the matching circuits, output from the matching circuits or both of them, or set overlapped into wide band to make it possible to input signals of different frequencies to the matching circuits or output from the matching circuits.

What is claimed is:

1. A communication circuit, comprising:

a nonresonant antenna; and an impedance-matching circuit connected to the nonresonant antenna, wherein the impedance-matching circuit has a transmission line, electric length $\theta_0$ and characteristic impedance $Z_1$ of the transmission line are calculated by equation (eq1) using external $QQ_{e1}$, reactance $X_a$, and radiation resistance $R_a$ of the nonresonant antenna, and $$\theta_0 = \frac{1}{2}\mathrm{Sinc}^{-1}\left(\frac{X_a}{2Q_{e1}R_a - X_a}\right),\ Z_1 = X_a \tan\theta_0. \quad \text{(eq1)}$$

2. A communication circuit, comprising:

a nonresonant antenna; and an impedance-matching circuit connected to the nonresonant antenna, wherein the impedance-matching circuit has a transmission line, electric length $\theta_0$ and characteristics admittance $Y_1$ of the transmission line are calculated by equation (eq2) using external Q $Q_{e1}$, susceptance $B_a$, conductance $G_a$ and internal admittance $Y_a$ of the nonresonant antenna, and $$\theta_0 = \frac{1}{2}\mathrm{Sinc}^{-1}\left(\frac{B_a}{2Q_{e1}G_a - B_a}\right),\ Y_1 = Y_a \tan\theta_0. \quad \text{(eq2)}$$

3. A design method of an impedance-matching circuit to be connected to a nonresonant antenna, wherein the impedance-matching circuit has a transmission line one of ends of which is connected to the nonresonant antenna, the design method comprising a step of determining electric length $\theta_0$ and characteristic impedance $Z_1$ of the transmission line by equation (eq3) using external Q $Q_{e1}$, reactance $X_a$, and radiation resistance $R_a$ of the nonresonant antenna, and $$\theta_0 = \frac{1}{2}\mathrm{Sinc}^{-1}\left(\frac{X_a}{2Q_{e1}R_a - X_a}\right),\ Z_1 = X_a \tan\theta_0. \quad \text{(eq3)}$$

4. A design method of an impedance-matching circuit to be connected to a nonresonant antenna, wherein the impedance-matching circuit has a transmission line one of ends of which is connected to the nonresonant antenna, the design method comprising a step of determining electric length $\theta_0$ and characteristic admittance $Y_1$ of the transmission line by equation (eq4) using external Q $Q_{e1}$, susceptance $B_a$, conductance $G_a$ and internal admittance $Y_a$ of the nonresonant antenna, and $$\theta_0 = \frac{1}{2}\mathrm{Sinc}^{-1}\left(\frac{B_a}{2Q_{e1}G_a - B_a}\right),\ Y_1 = Y_a \tan\theta_0. \quad \text{(eq4)}$$

* * * * *